US007500922B2

(12) United States Patent
Takeuchi

(10) Patent No.: US 7,500,922 B2
(45) Date of Patent: Mar. 10, 2009

(54) GOLF CLUB SHAFT

(75) Inventor: Hiroyuki Takeuchi, Hyogo (JP)

(73) Assignee: SRI Sports Limited, Kobe-shi, Hyogo (JP)

( * ) Notice: Subject to any disclaimer, the term of this patent is extended or adjusted under 35 U.S.C. 154(b) by 0 days.

(21) Appl. No.: 11/808,874

(22) Filed: Jun. 13, 2007

(65) Prior Publication Data

US 2008/0026868 A1 Jan. 31, 2008

(30) Foreign Application Priority Data

Jul. 27, 2006 (JP) ..... 2006-205364

(51) Int. Cl.
*A63B 53/10* (2006.01)

(52) U.S. Cl. ..... 473/319

(58) Field of Classification Search ..... 473/319
See application file for complete search history.

(56) References Cited

U.S. PATENT DOCUMENTS

| | | | | |
|---|---|---|---|---|
| 1,486,573 | A * | 3/1924 | Forsyth | 473/318 |
| 5,721,030 | A * | 2/1998 | Okada | 428/36.3 |
| 5,743,811 | A * | 4/1998 | Bird | 473/319 |
| 5,810,676 | A * | 9/1998 | Bird | 473/319 |
| 6,354,957 | B1 * | 3/2002 | Saito | 473/289 |
| 6,413,343 | B1 * | 7/2002 | Smith et al. | 156/156 |
| 6,764,414 | B2 * | 7/2004 | Kumamoto | 473/297 |
| 2002/0160131 | A1 * | 10/2002 | Ohira et al. | 428/35.7 |
| 2003/0148820 | A1 * | 8/2003 | Kumamoto | 473/318 |
| 2004/0092330 | A1 * | 5/2004 | Meyer et al. | 473/318 |
| 2005/0107182 | A1 * | 5/2005 | Meyer et al. | 473/318 |
| 2008/0032812 | A1 * | 2/2008 | Sorenson | 473/292 |

FOREIGN PATENT DOCUMENTS

| | | | |
|---|---|---|---|
| JP | 6-339551 | A | 12/1994 |
| JP | 2003-70944 | A | 3/2003 |
| JP | 2004-275324 | A | 10/2004 |

* cited by examiner

*Primary Examiner*—Stephen L. Blau
(74) *Attorney, Agent, or Firm*—Birch, Stewart, Kolasch & Birch, LLP

(57) ABSTRACT

A golf club shaft (10), tubular and having a hollow portion, which includes a laminate of fiber reinforced prepregs (21 through 23, 24A, 25 through 29). The laminate has a first part (I) composed of a plurality of first prepregs (P1) and a second part (P2). A loss factor (tan δ) of the first part (I) is set to not less than 0.005 nor more than 0.02, when the loss factor is measured at a frequency of 10 Hz under a condition of 10° C. A loss factor (tan δ) of the second part (P2) is set to not less than 0.10 nor more than 0.50, when the loss factor is measured at a frequency of 10 Hz under the condition of 10° C.

7 Claims, 14 Drawing Sheets

[Prior Art]

[Prior Art]

GOLF CLUB SHAFT

This nonprovisional application claims priority under 35 U.S.C. § 119(a) on Patent Application No(s). 2006-205364 filed in Japan on Jul. 27, 2006, the entire contents of which are hereby incorporated by reference.

FIELD OF THE INVENTION

The present invention relates to a golf club shaft (hereinafter often referred to as merely shaft). More particularly, the present invention is intended to soften an unpleasant vibration and a sound generated when a ball is hit.

DESCRIPTION OF THE RELATED ART

In recent years, to allow a golf player to hit the ball at a high speed and with a high stability, the present tendency is to make a golf club head heavy and make a golf club shaft lightweight. Therefore fiber reinforced resin such as a carbon prepreg that is lightweight and has a high specific strength and specific rigidity is mainly used as a material of the golf club shaft.

Such a lightweight golf club shaft has an advantage of increasing a head speed when a golf club is hit and increasing the flight distance of the ball, whereas it has a disadvantage of readily transmitting an unpleasant vibration and impact to a player when the ball is hit because of its light weight. Because the shaft is lightweight, the shaft has a high-frequency vibration different from the vibration which occurs in a conventional shaft. Caused by the high-frequency vibration, the player has an unpleasant feeling when the ball is hit. Therefore in recent years, there is an increase in the number of golf players having troubles on elbows and shoulders owing to vibrations and impacts when the ball is hit.

To overcome the above-described problem, the following golf club shafts are proposed: In the disclosure the golf club shaft disclosed in Japanese Patent Application Laid-Open No. 6-339551 (patent document 1), as shown in FIGS. 16A and 16B, to suppress the high-order natural frequency components which cause a golf player to feel unpleasant when the ball is hit, there is provided inside the grip part 2 of the shaft 1 the dynamic vibration absorber 3 in which the weight member 3*d* through which the shaft 3*c* is inserted is supported by the cylindrical member 3*a* through the viscoelastic member 3*b*.

As disclosed in Japanese Patent Application Laid-Open No. 2003-70944 (patent document 2), the present applicant proposed the golf club shaft having the vibration-absorbing member 5 made of the elastic material having tan δ set to not less than 0.7 at 10° C. The vibration-absorbing member 5 is disposed in the hollow portion of the shaft 4 at the grip side thereof, as shown in FIGS. 17A through 17D. The vibration-absorbing member 5 has the body 5*a* having the hollow portion, the central portion 5*c* connected to the body 5*a* through the connection portion 5*b*, and the projected portion 5*d* provided on the periphery of the body 5*a*, with the projected portion 5*d* in contact with the inner peripheral surface of the hollow portion.

The central portion 5*c* is capable of resonating with the vibration of the shaft 4, thereby effectively absorbing vibration and impact when the ball is hit.

As disclosed in Japanese Patent Application Laid-Open No. 2004-275324 (patent document 3), the present applicant also proposed the golf club shaft in which the vibration-absorbing member made of the dipole conversion material is interposed between the inclined layer and the reversely inclined layer both made of the fiber reinforced prepreg. The loss tangent (tan δ) of the vibration-absorbing member is set to not less than 1.0 at 10° C.

In the above-described golf club shaft, the vibration-absorbing member is capable of efficiently decreasing the torsional vibration generated by the twist of the inclined layer and the reversely inclined layer in opposite directions and the subsequent returning operation thereof to the original state.

In the golf club shaft disclosed in the patent document 1, the weight member 3*d* of the dynamic vibration absorber 3 is heavy with respect to the weight of the weight member 3*d* and the shaft 3*c*. Thus there is room for improvement in the weight of the golf club shaft.

In the golf club shaft disclosed in the patent document 2, because the vibration-absorbing member 5 is bonded to the inner peripheral surface of the hollow portion of the shaft 4 at many portions, the vibration direction of the central portion 5*c* is restricted. There is room for improvement in its vibration-absorbing performance.

In the golf club shaft disclosed in the patent document 3, the vibration-absorbing member is inserted between layers of the laminate. The material of the vibration-absorbing member is different from that of the shaft. Thus there is room for improvement in the balance between the desired performance of the shaft and the strength thereof and the like.

Patent document 1: Japanese Patent Application Laid-Open No. 6-339551

Patent document 2: Japanese Patent Application Laid-Open No. 2003-70944

Patent document 3: Japanese Patent Application Laid-Open No. 2004-275324

SUMMARY OF THE INVENTION

The present invention has been made in view of the above-described problems. Therefore it is an object of the present invention to provide a golf club shaft (hereinafter often referred to as merely shaft) which is lightweight and has a high strength and is capable of softening unpleasant vibration and impact generated when a ball is hit.

To achieve the object, the present invention provides a golf club shaft, tubular and having a hollow portion, which includes a laminate of fiber reinforced prepregs composed of a matrix resin and reinforcing fibers impregnated with the matrix resin. The laminate includes a first part composed of a plurality of first prepregs and a second part. A loss factor (tan δ) of the first part is set to not less than 0.005 nor more than 0.02, when the loss factor is measured at a frequency of 10 Hz under a condition of 10° C. A loss factor (tan δ) of the second part is set to not less than 0.10 nor more than 0.50, when the loss factor is measured at a frequency of 10 Hz under the condition of 10° C.

As the loss factor (tan δ) of the prepreg becomes larger, the transformation of the energy of the prepreg becomes increasingly large. Thereby it is possible to suppress vibration and impact generated when the ball is hit.

The golf club shaft having the above-described construction has the first laminate and the second prepreg whose loss factor is different from that of the first laminate. The first laminate having the lower loss factor maintains the strength and rigidity of the shaft, whereas the second prepreg having the higher loss factor is capable of enhancing the vibration-damping performance thereof.

In the present invention, the vibration-damping performance of the shaft is improved not by disposing a material of a different kind such as a vibration-damping material in the laminate of the fiber reinforced prepregs or inside the shaft, but by adjusting the loss factors of the fiber reinforced prepregs, i.e., by making the loss factor of the second prepreg higher than that of the first laminate. Therefore the shaft does not have an abnormal sound caused by the use of the material of a different kind. Further it possible to enhance the vibration-damping performance of the shaft without increasing the weight of the shaft.

The loss factor of the first laminate is measured in a state in which a plurality of prepregs composing the first laminate is hardened.

The loss factor (tan δ) of the first laminate is measured at the frequency of 10 Hz under the condition of the temperature of 10° C. The reason the loss factor of the first laminate is set to not less than 0.005 nor more than 0.02 is as follows: If the loss factor thereof is less than 0.005, the vibration-damping performance of the shaft becomes too low. On the other hand, if the loss factor thereof is more than 0.02, the strength of the shaft becomes too low. The loss factor of the first laminate I is set to favorably not less than 0.007 and more favorably not less than 0.010. The loss factor of the first laminate I is set to favorably not more than 0.018 and more favorably not more than 0.015.

The loss factor (tan δ) of the second prepreg is also measured at the frequency of 10 Hz under the condition of the temperature of 10° C. The reason the loss factor of the second prepreg is set to not less than 0.10 nor more than 0.50 is as follows: If the loss factor thereof is less than 0.10, the effect of improving the vibration-damping performance of the shaft cannot be displayed sufficiently. Thus the shaft has a low vibration-damping performance. On the other hand, if the loss factor of the shaft is more than 0.50, the strength of the shaft is affected adversely to a high extent. Thus the shaft is not provided with a necessary strength. The loss factor of second prepreg is set to favorably not less than 0.20 and more favorably not less than 0.30. The loss factor of the first laminate is set to favorably not more than 0.45 and more favorably not more than 0.40.

The loss factor (tan δ) is measured in a bending mode by using a viscoelasticity-measuring apparatus (produced by Leology Inc.). As the measuring conditions, the frequency, the temperature, the temperature rise speed, and the displacement amplitude are set to 10 Hz, 10° C., 4° C./minute, and ±50 μm respectively.

A laminate having nine layers composed of the same prepregs layered on each other was used as a specimen with fibrous angles of reinforcing fibers thereof disposed alternately orthogonally to each other. The laminate was cut to 30 mm in length and 5 mm in width, with the direction in which the reinforcing fibers of an outer-layer prepreg extended in coincidence with the longitudinal direction of the specimen. The specimen is chucked in a length of 5 mm at both ends in the longitudinal direction thereof. Thus a deforming portion of the specimen is 20 mm. The loss factor of the second laminate (second prepreg) is measured by using a specimen formed by carrying out a method similar to the above-described method used to form the specimen of the first laminate.

The reason the temperature condition is set to not less than 0° C. nor more than 10° C. is attributed to the rule of frequency-temperature conversion rule which is the rule of thumb in the measurement of viscoelasticity. In the rule of thumb, one order of the frequency is regarded as being equivalent to 10° C. The out-of-plane primary vibration (vibration in direction in which ball is hit) of a golf club shaft is 40 to 100 Hz. The out-of-plane secondary vibration (vibration in twist direction) thereof is 150 to 250 Hz. Therefore attention is paid to the temperature range of 0° C. to 10° C. in terms of the relationship between a room temperature (10° C. to 30° C.) at which the golf club shaft is used and the above-described frequency. A forced vibration generated when the ball is hit falls in the range of 30 to 1000 Hz. Therefore by specifying the loss factor measured in the above-described temperature range to the above-described range, it is possible to efficiently suppress vibration generated by an impact.

It is preferable that the weight of the second prepreg is set to not less than 1% nor more than 15% of the weight of the first laminate composed of a plurality of the first prepregs layered on one another.

If the weight of the second prepreg is set to less than 1%, the second laminate is incapable of displaying the vibration-damping effect. On the other hand, if the weight of the second prepreg is set to more than 15%, the shaft is adversely affected to a high extent in its strength. Thus the shaft has an insufficient strength. The weight of the second prepreg is set to more favorably not less than 2% and most favorably not less than 3%. The weight of the second prepreg is set to more favorably not more than 14% and most favorably not more than 13%.

It is preferable that supposing that an entire thickness of the fiber reinforced resin layer is 100%, at least one part of the second prepreg is disposed in a thickness range within 20% of the entire thickness of the fiber reinforced resin layer at both sides in a thickness direction with respect to a central position of the entire thickness.

The thickness range within 20% at both sides of the entire thickness in the thickness direction with respect to the central position of the entire thickness is the portion subjected to the largest shear force when an impact is applied to the golf club shaft. Thus by disposing the second prepreg within the above-described thickness range, the second prepreg is capable of efficiently damping vibration generated in the shaft. It is more favorable to dispose the second prepreg at more favorably not less than 50% thereof and most favorable to dispose it at not less than 100% thereof in the above-described thickness range.

It is preferable to use thermosetting resin as the matrix resin component of the second prepreg to improve the strength of the shaft and the moldability of the matrix resin component. The loss factor of the shaft can be enhanced by adding various kinds of additives such as an activator, liquid rubber, a softener, and the like which increase the moment amount of a dipole to the thermosetting resin.

In adding the activator to the thermosetting resin, it is preferable to add the activator and a hardening agent for hardening the thermosetting resin to the thermosetting resin and thereafter heat a mixture to compatibilize the activator with the thermosetting resin. In addition, the following agents may be added to the thermosetting resin as necessary: a setting-accelerating agent, a plasticizer, a stabilizer, an emulsifying agent, a filler, a reinforcing agent, a colorant, a foaming agent, an antioxidant, an ultraviolet prevention agent, and a lubricant.

When the activator having the dipole is dispersed in the matrix resin composition and compatibilized with the thermosetting resin, electric charges of positive and negative dipoles are attracted to each other. Thus the positive and negative dipoles are present in a stable state in an electrical connection with the resin. When vibration is applied to the composition, the dipoles are displaced and separated from each other. Thereafter a restoring action of attracting the dipoles to each other operates. At that time, the dipoles contact high-molecular chains of the matrix resin, with the dipoles in contact with each other. As a result, a large quantity of a vibration energy is transformed into a thermal energy as a frictional heat. Owing to this action, it is possible to absorb the vibration energy of the shaft efficiently and attenuate the vibration and impact effectively.

It is preferable that the second prepreg comprises a composition containing epoxy resin and one or more activators selected from among compounds having a benzotriazole group and compounds having a diphenyl acrylate group added to the epoxy resin. More specifically, the DL-26, the DL-30 produced by CCI Inc. can be used as the matrix resin composition of the second prepreg.

By adding the above-described activator to the epoxy resin, the epoxy resin is softened, it is possible to increase the loss factor of the matrix resin composition and the moment amount of the dipole in the matrix resin composition.

It is preferable that the epoxy resin for use in the second prepreg has a long chain in its molecules, a small number of side chains, an equivalent weight of 250 to 350, and a molecular weight of 500 to 700. Such epoxy resin has a small number of crosslinking points, thus efficiently softening the matrix resin composition and enhancing the loss factor.

It is preferable to use a mixture of propylene-ether epoxy resin and G-glycidyl ether epoxy resin. In addition, it is possible to use various epoxy resins by combining them with each other. Although it is possible to adjust the loss factor in dependence on a mixing amount of the activator, it is preferable to set the mixing amount of the activator to 10 to 200 parts by weight for 100 parts by weight of the resin component.

It is possible to use thermoplastic resin or a mixture of the thermoplastic resin and the thermosetting resin as the matrix resin component of the second prepreg.

As described above, the thermosetting resin is preferably used as the matrix resin component of the first prepreg to allow the shaft to have a necessary strength and rigidity. As the matrix resin component of the first prepreg, it is preferable to use the same kind of resin as the matrix resin component of the second prepreg.

When the epoxy resin is used for the first prepreg, it is preferable to use the epoxy resin having an equivalent weight and a molecular weight smaller than that of the second prepreg. More specifically, bisphenyl A-type epoxy resin is preferable. Various additives may be added to the epoxy resin.

The modulus of elasticity in tension of the reinforcing fiber of the first prepreg and the second prepreg is set favorably to the range of not less than 15 tonf/mm$^2$ nor more than 60 tonf/mm$^2$.

The modulus of elasticity in tension of the reinforcing fiber of the first prepreg and the second prepreg is set to the above-described range for the following reason. If the modulus of elasticity in tension of the reinforcing fiber thereof is less than 15 tonf/mm$^2$, the rigidity and restitution performance of the shaft become too low. On the other hand, if the modulus of elasticity in tension of the reinforcing fiber thereof is more than 60 tonf/mm$^2$, it is difficult to obtain a desired impact resistance. The modulus of elasticity in tension of the reinforcing fiber thereof is set to more favorably not less than 20 tonf/mm$^2$ and more favorably not less than 25 tonf/mm$^2$. The modulus of elasticity in tension of the reinforcing fiber thereof is set to more favorably not more than 55 tonf/mm$^2$ and more favorably not more than 50 tonf/mm$^2$.

It is preferable that the fiber content of the first prepreg and that of the second prepreg are set to not less than 45% nor more than 85%. If the fiber content is less than 45%, the rigidity of the shaft becomes too low. On the other hand, if the fiber content is more than 85%, it is difficult to obtain a desired impact resistance. The fiber content means (volume of fiber contained in prepreg)/(entire volume of prepreg)× 100.

It is preferable that the second prepreg is disposed in a region (hereinafter referred to as distal-side 30% region) from a head-side tip of the golf club shaft to a position spaced at an interval of 30% of a whole length of the golf club shaft from the head-side tip of the golf club shaft. The distal-side 30% region is a portion which deforms greatly when the deformation behavior and vibration mode of the shaft is considered. It is possible to enhance an impact-absorbing energy by disposing the second laminate in the distal-side 30% region.

The length of the second prepreg in the axial direction of the shaft is favorably not less than 100 mm nor more than 500 mm. If the length of the second prepreg in the axial direction thereof is less than 100 mm, the second prepreg is incapable of sufficiently displaying the vibration-damping effect. If the length of the second prepreg exceeds 500 mm, the shaft is affected adversely to a high extent in the strength and rigidity thereof. Thus it is difficult to provide the shaft a desired strength and rigidity. The length of the second prepreg is set to more favorably not less than 120 mm and most favorably not less than 150 mm. The length of the second prepreg is set to more favorably not more than 480 mm and most favorably not more than 450 mm.

It is preferable that the second prepreg is disposed over the whole periphery of the shaft but may be disposed partly or at a plurality of positions.

It is preferable that an orientation angle of a reinforcing fiber of the second prepreg to an axis of the golf club shaft is set to not less than 30° nor more than 90°. If the above-described orientation angle of the reinforcing fiber of the second prepreg is less than 30°, the bending direction of the fibrous angle and that of the shaft are apt be coincide with each other. Thereby an interlaminar deformation becomes low owing to the elasticity of the reinforcing fibers, and the second prepreg has a low vibration-absorbing effect.

As reinforcing fibers for use in the first and second prepregs, fibers used as high-performance reinforcing fibers can be preferably used. For example, it is possible to list carbon fiber, graphite fiber, aramid fiber, silicon carbide fiber, alumina fiber, boron fiber, glass fiber, and aromatic polyester fiber, and ultra-high-molecular polyethylene fiber. Metal fibers can be also used.

These reinforcing fibers can be used in the form of long or short fibers. A mixture of two or more of these reinforcing fibers may be used. The configuration and arrangement of the reinforcing fibers are not limited to specific ones. For example, they may be arranged in a single direction or a random direction. The reinforcing fibers may have the shape of a sheet, a mat, fabrics, braids, and the like.

As the reinforcing fiber for use in the second prepreg, the carbon fiber can be preferably used to provide the shaft with a high strength and a low specific gravity. The carbon fiber is used in favorably not less than 50%, more favorably not less than 75%, and most favorably not less than 100% of the entire fiber reinforced resin layer constructing the shaft.

It is preferable that the weight of the golf club shaft of the present invention is set to not less than 30 g nor more than 70 g. If the weight of the golf club shaft is less than 30 g, the golf club shaft is thin and hence has a very low strength. On the other hand, if the weight of the golf club shaft exceeds 70 g, the golf club shaft is so heavy that the operability thereof is low.

As described above, according to the present invention, the laminate of the fiber reinforced prepregs constructing the golf club shaft is composed of the first laminate, having the lower loss factor, which consists of a plurality of the first prepregs and the second prepreg having the higher loss factor. Thereby the first laminate maintains the strength and rigidity of the shaft, whereas the second prepreg is capable of enhancing the vibration-damping performance thereof.

Further in the present invention, the vibration-damping performance of the shaft is improved not by using a material of a different kind such as a vibration-damping material, but by adjusting the loss factors of the fiber reinforced prepregs. Therefore the shaft does not have an abnormal sound caused by the use of the material of a different kind. Further it is possible to enhance the vibration-damping performance of the shaft without increasing the weight of the shaft.

DETAILED DESCRIPTION OF THE PREFERRED EMBODIMENTS

The embodiments of the present invention will be described below with reference to the drawings.

Figure 1:
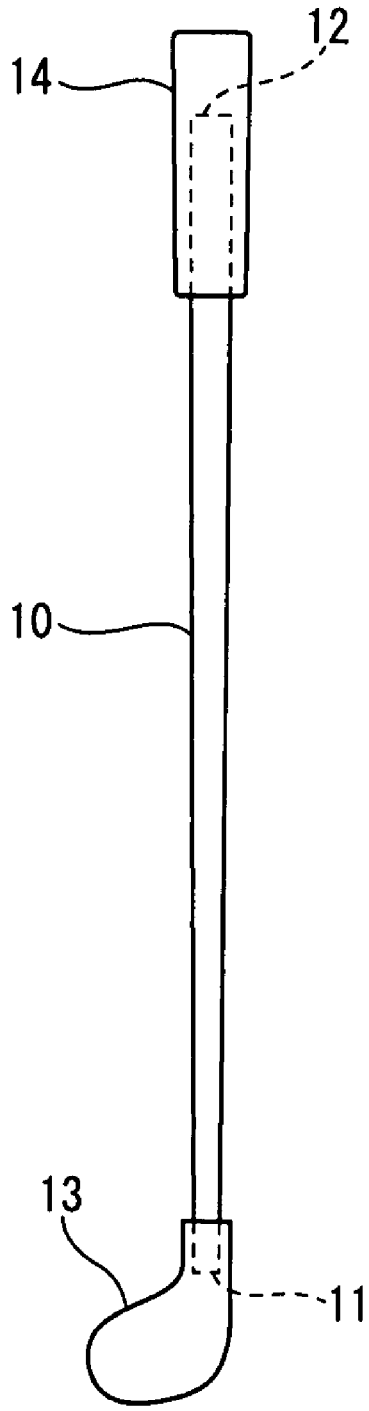
FIG. 1 is a schematic view showing a golf club according to a first embodiment of the present invention.
Figure 2:
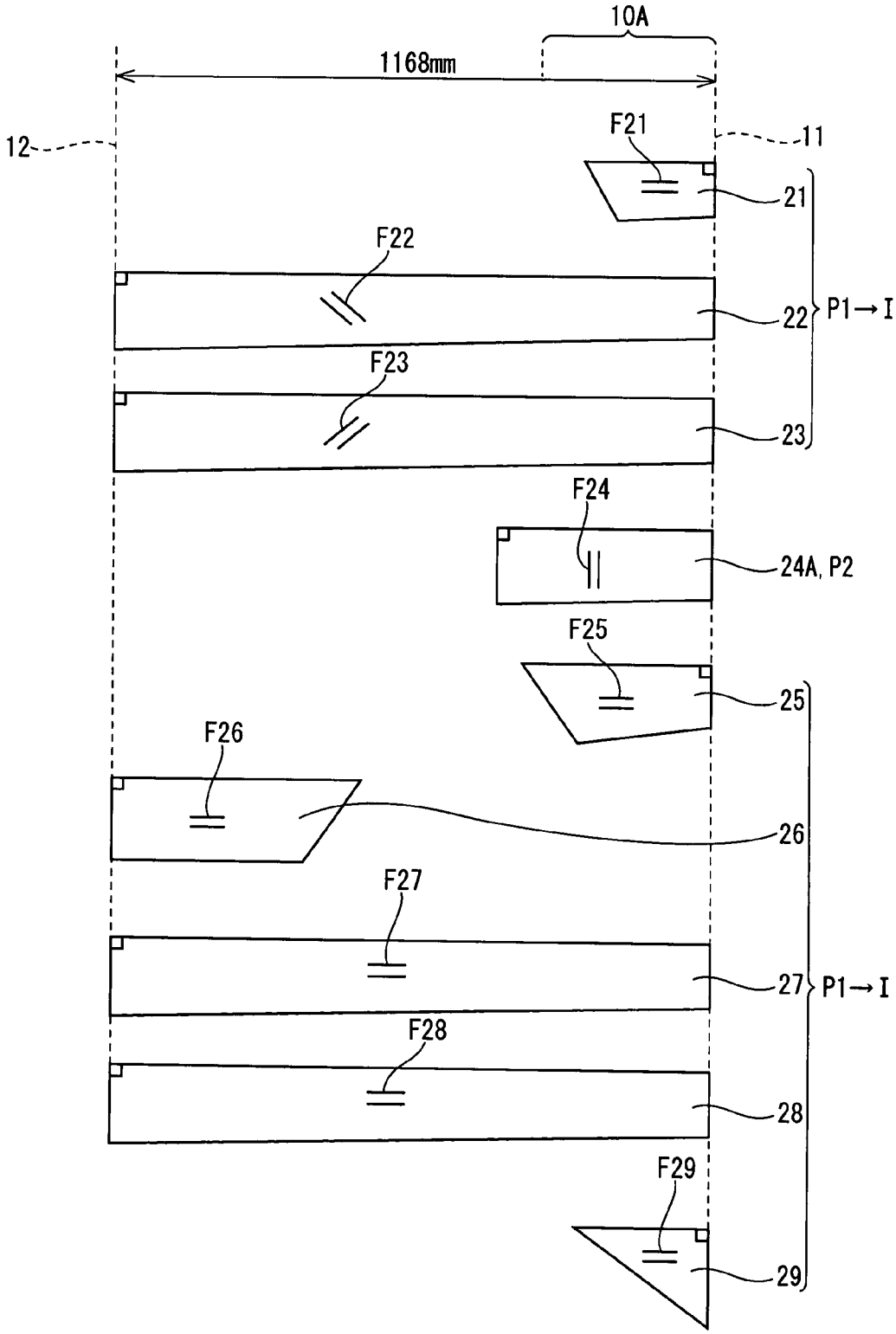
FIG. 2 shows a layered construction of fiber reinforced prepregs of the golf club shaft shown in FIG. 1.

FIGS. 1 and 2 show a golf club shaft (hereinafter often referred to as merely shaft) 10 according to a first embodiment of the present invention.

The shaft 10 is composed of a tapered long tubular body composed of a laminate of fiber reinforced prepregs 21 through 23, 24A, 25 through 29.

A head 13 is mounted on a head-side tip 11 of the shaft 10 having the smallest diameter. A grip 14 is mounted on a grip-side butt 12 thereof having the largest diameter.

The full length of the shaft 10 is set to 46 inches (1168 mm). The weight of the shaft 10 is set to 59.5 g before the shaft 10 is painted (before parts are mounted).

The fiber reinforced prepregs 21 through 23, 24A, 25 through 29 are composed of a first prepreg P1 having a low loss factor (tan δ) when the loss factor thereof is measured at a frequency of 10 Hz under the condition of 10° C. and a second prepreg P2 having a high loss factor when the loss factor thereof is measured in the same condition respectively.

The prepregs 21 through 23 and 25 through 29 correspond to the first prepreg P1. The prepreg 24A corresponds to the second prepreg P2.

As the first prepreg P1, a commercially available prepreg (produced by Toray Industries Inc.) containing carbon fibers serving as the reinforcing fiber of the first prepreg P1 and epoxy resin (additive is not added) serving as the matrix resin thereof is used. The first prepreg P1 constructs the first prepreg P1 having the low loss factor (tan δ) when the loss factor is measured at the frequency of 10 Hz under the condition of 10° C. In the first embodiment, the loss factor of the first laminate I (state in which layered prepregs of first prepreg are hardened) is set to 0.01.

The second prepreg P2 is formed as follows: The carbon fibers are wound round a drum by making them in a predetermined direction, with the carbon fibers containing the epoxy resin and an activator added thereto being impregnated with a matrix resin composition ("DL-26" produced by CCI Inc.). After a predetermined amount of the carbon fibers impregnated with the matrix resin composition is wound round the drum, they are cut off the drum. Thereafter they are heated at 80° C. to 100° C. to form the second prepreg P2 in a pseudo-hardened state.

The second prepreg P2 consists of one prepreg 24A. The loss factor of the second prepreg P2 is set to 0.3.

The detail of the prepregs 21 through 29 is described with reference to FIGS. 1 and 2.

The prepreg 21 is disposed at the head-side tip of the shaft 10 and has a length of 267 mm and a thickness of 0.1030 mm. The width of the prepreg 21 is so set that a mandrel is wound with three turns thereof to form three layers. A reinforcing fiber F21 forms an angle of 0° to the axis of the shaft 10 and has a modulus of elasticity in tension of 24 tonf/mm$^2$.

The prepreg 22 is disposed over the full length of the shaft 10 and has a thickness of 0.0820 mm. The width of the prepreg 22 is so set that the mandrel is wound with three turns thereof to form three layers. A reinforcing fiber F22 forms an angle of −45° to the axis of the shaft 10 and has a modulus of elasticity in tension of 40 tonf/mm$^2$.

The prepreg 23 is disposed over the full length of the shaft 10 and has a thickness of 0.0820 mm. The width of the prepreg 23 is so set that the mandrel is wound with three turns thereof to form three layers. A reinforcing fiber F23 forms an angle of +45° to the axis of the shaft 10 and has a modulus of elasticity in tension of 40 tonf/mm$^2$.

The prepreg 24A is disposed at the head-side tip of the shaft 10 and has a length of 400 mm and a thickness of 0.0840 mm. The width of the prepreg 24A is so set that the mandrel is wound with one turn thereof to form one layer. A reinforcing fiber F24 forms an angle of 90° to the axis of the shaft 10 and has a modulus of elasticity in tension of 30 tonf/mm$^2$.

The prepreg 25 is disposed at the head-side tip of the shaft 10 and has a length of 367 mm and a thickness of 0.0840 mm. The width of the prepreg 25 is so set that the mandrel is wound with three turns thereof to form three layers. A reinforcing fiber F25 forms an angle of 0° to the axis of the shaft 10 and has a modulus of elasticity in tension of 24 tonf/mm$^2$.

The prepreg 26 is disposed at the grip-side tip of the shaft 10 and has a length of 453 mm and a thickness of 0.0840 mm. The width of the prepreg 26 is so set that the mandrel is wound with three turns thereof to form three layers. A reinforcing fiber F26 forms an angle of 0° to the axis of the shaft 10 and has a modulus of elasticity in tension of 30 tonf/mm$^2$.

The prepreg 27 is disposed over the full length of the shaft 10 and has a thickness of 0.1450 mm. The width of the prepreg 27 is so set that the mandrel is wound with two turns thereof to form two layers. A reinforcing fiber F27 forms an angle of 0° to the axis of the shaft 10 and has a modulus of elasticity in tension of 30 tonf/mm$^2$.

The prepreg 28 is disposed over the full length of the shaft 10 and has a thickness of 0.1450 mm. The width of the prepreg 28 is so set that the mandrel is wound with one turn thereof to form one layer. A reinforcing fiber F28 forms an angle of 0° to the axis of the shaft 10 and has a modulus of elasticity in tension of 30 tonf/mm$^2$.

The prepreg 29 is disposed at the head-side tip of the shaft 10 and has a length of 207 mm and a thickness of 0.1030 mm. The width of the prepreg 29 is so set that the mandrel is wound with five turns thereof to form five layers. A reinforcing fiber F29 forms an angle of 0° to the axis of the shaft 10 and has a modulus of elasticity in tension of 24 tonf/mm$^2$.

As shown in FIG. 2, in the shaft 10, the prepregs 21 through 29 are sequentially wound round a mandrel (not shown) and layered from the inner peripheral side of the shaft, namely, in the order from the prepreg 21 to the prepreg 29 by using a sheet winding method. Thereafter to perform integral molding, a tape (not shown) made of polypropylene is wound round the laminate of the prepregs 21 through 29. After the laminate around which the tape has been wound is heated in an oven under pressure to harden the resin, the mandrel is drawn out of the laminate. After the surface of the shaft 10 is polished, both ends thereof are cut. Thereafter the shaft 10 is painted.

In the first embodiment, the weight of the first laminate I consisting of the first prepreg P1 is set to 58.0 g. The weight of the second prepreg P2 is set to 1.5 g.

At the distal side of the shaft 10 where the second prepreg P2 is disposed, 21 layers including 20 layers of the first laminate I and one layer of the second prepreg P2 are disposed. Only one layer of the second prepreg is disposed at the tenth layer from the inner peripheral side of the shaft. Supposing that the entire thickness of the shaft 10 is 100%, the second prepreg P2 is disposed in the thickness region of 30% to 70% from the inner peripheral side of the shaft, namely, within the region disposed at ±20% (hereinafter referred to "central region in the thickness direction of the shaft") with respect to the center in the direction of the thickness of the shaft 10.

The shaft 10 having the above-described construction is capable of having a desired strength by the first laminate I having the lower loss factor and an enhanced vibration-absorbing performance by the second prepreg P2. The second prepreg P2 is made of the fiber reinforced prepreg 24A formed by modifying the matrix resin and not a vibration-damping material made of a different kind of material. Therefore the shaft does not have an abnormal sound caused by the use of a different kind of material. Further it is possible to enhance the vibration-damping performance of the shaft without increasing the weight of the shaft.

The weight of the second prepreg P2 is about 2% of that of the first laminate I which falls within the range of not less than 1% nor more than 15%. Therefore the shaft 10 is allowed to have a strength and vibration-absorbing performance in a favorable balance without increasing the weight of the shaft.

The second prepreg P2 is entirely (100%) disposed in the central region in the direction of the thickness of the shaft 10 where the largest shear force is generated when the ball is hit, thus efficiently damping vibration and impact.

The modulus of elasticity in tension of the reinforcing fiber of the first prepreg P1 and the second prepreg P2 is in the range of not less than 15 tonf/mm$^2$ nor more than 60 tonf/mm$^2$. Therefore the shaft 10 is allowed to have its rigidity, restitution performance, and impact resistance in a favorable balance.

Further because the fibrous angle of the second prepreg P2 is set orthogonally to the bending direction of the shaft 10. Thereby an interlaminar deformation becomes large, and the second prepreg P2 is capable of enhancing the vibration-absorbing effect.

The second prepreg is disposed in the region occupying 34% of the whole length of the shaft 10 from the head-side tip 11. That is, most of the length of the second prepreg P2, namely, about 88% of the length thereof is disposed in the distal-side 30% region 10A of the shaft 10 subjected to the largest shear force when the ball is hit. Thereby the second prepreg P2 is capable of displaying a high vibration-absorbing effect.

Figure 3:
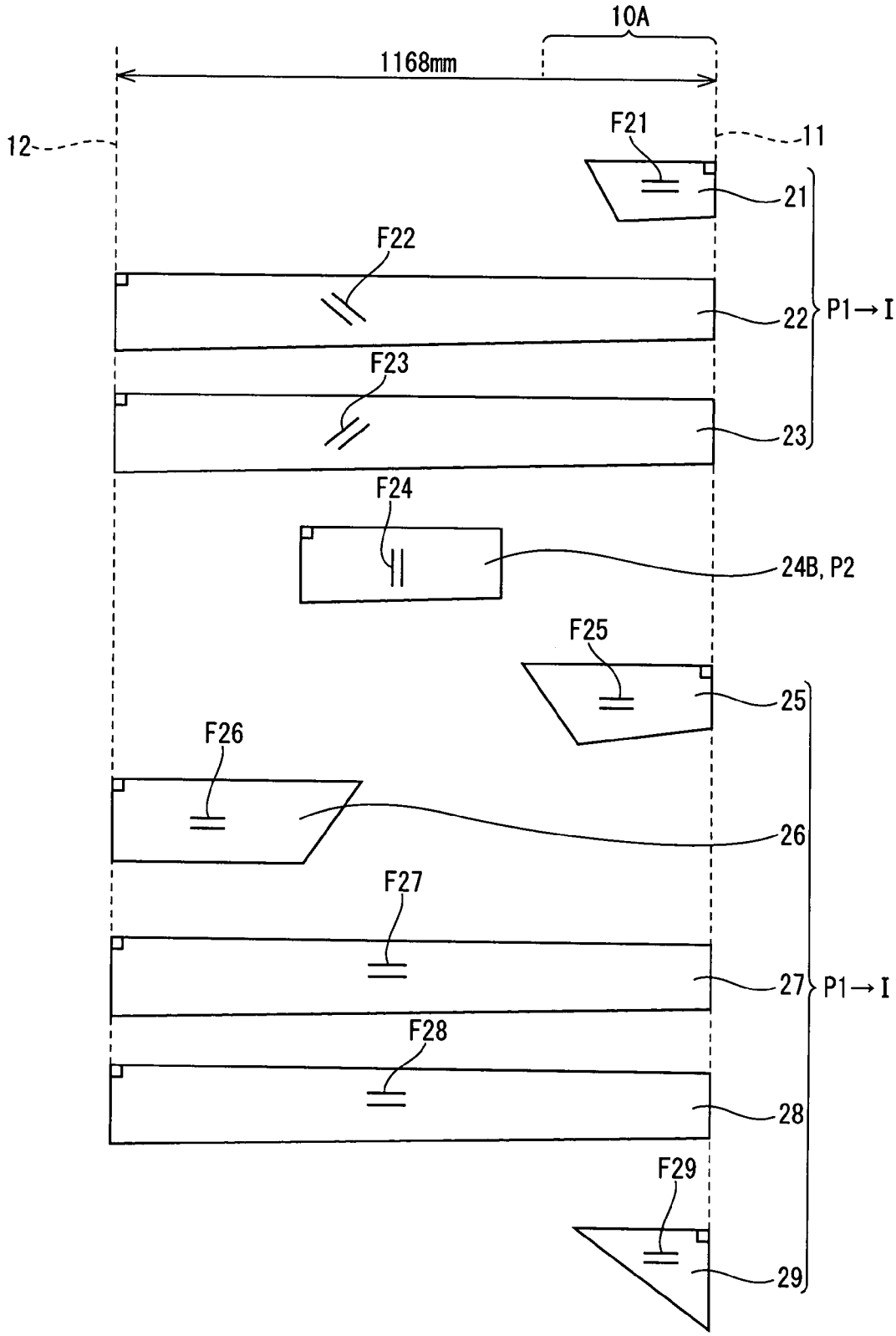
FIG. 3 shows a layered construction of fiber reinforced prepregs of a golf club shaft of a second embodiment.

FIG. 3 shows the second embodiment of the present invention. The second prepreg P2 is disposed at a central portion of the shaft 10 in the longitudinal direction thereof.

More specifically, a fiber reinforced prepreg 24B constructing the second prepreg P2 is disposed in a region spaced at an interval of 400 mm to 800 mm from the head-side tip 11. The fiber reinforced prepreg 24B has a thickness of 0.0840 mm. The width of the fiber reinforced prepreg 24B is so set that the mandrel is wound with one turn thereof to form one layer. The reinforcing fiber F24 forms an angle of 90° to the axis of the shaft 10 and has a modulus of elasticity in tension of 30 tonf/mm$^2$.

The DL-26 produced by CCI Inc. for use in the prepreg 24A of the first embodiment is used as the matrix resin composition for use in the prepreg 24B. The loss factor of the second prepreg P2 is set to 0.3.

The total weight of the shaft 10 is set to 60 g. The weight of the first laminate I is set to 58.0 g. The weight of the second prepreg P2 is set to 2.0 g which is about 3% of the weight of the first laminate I.

At the central portion of the shaft 10 where the second prepreg P2 is disposed, 13 layers including 12 layers of the first laminate I and one layer of the second prepreg P2 are disposed. Only one layer of the second prepreg P2 is disposed at the seventh layer from the inner peripheral side of the shaft. The second prepreg P2 is entirely (100%) disposed inside the central region in the thickness direction of the shaft.

The other constructions of the shaft of the second embodiment are identical to those of the shaft of the first embodiment.

In shaft of the second embodiment, because the second prepreg P2 is not disposed in the distal-side 30% region 10A of the shaft 10, the shaft is inferior to that of the first embodiment in the vibration-absorbing performance. But the second prepreg P2 is entirely disposed in the central region in the thickness direction of the shaft to which a high shear force is applied. Thus the shaft of the second embodiment has an effective vibration-absorbing performance. Further the ratio of the weight of the second prepreg P2 to the weight of the first laminate I is set to 3%. Therefore the shaft of the second embodiment is capable of maintaining a necessary strength without increasing the weight thereof.

Figure 4:
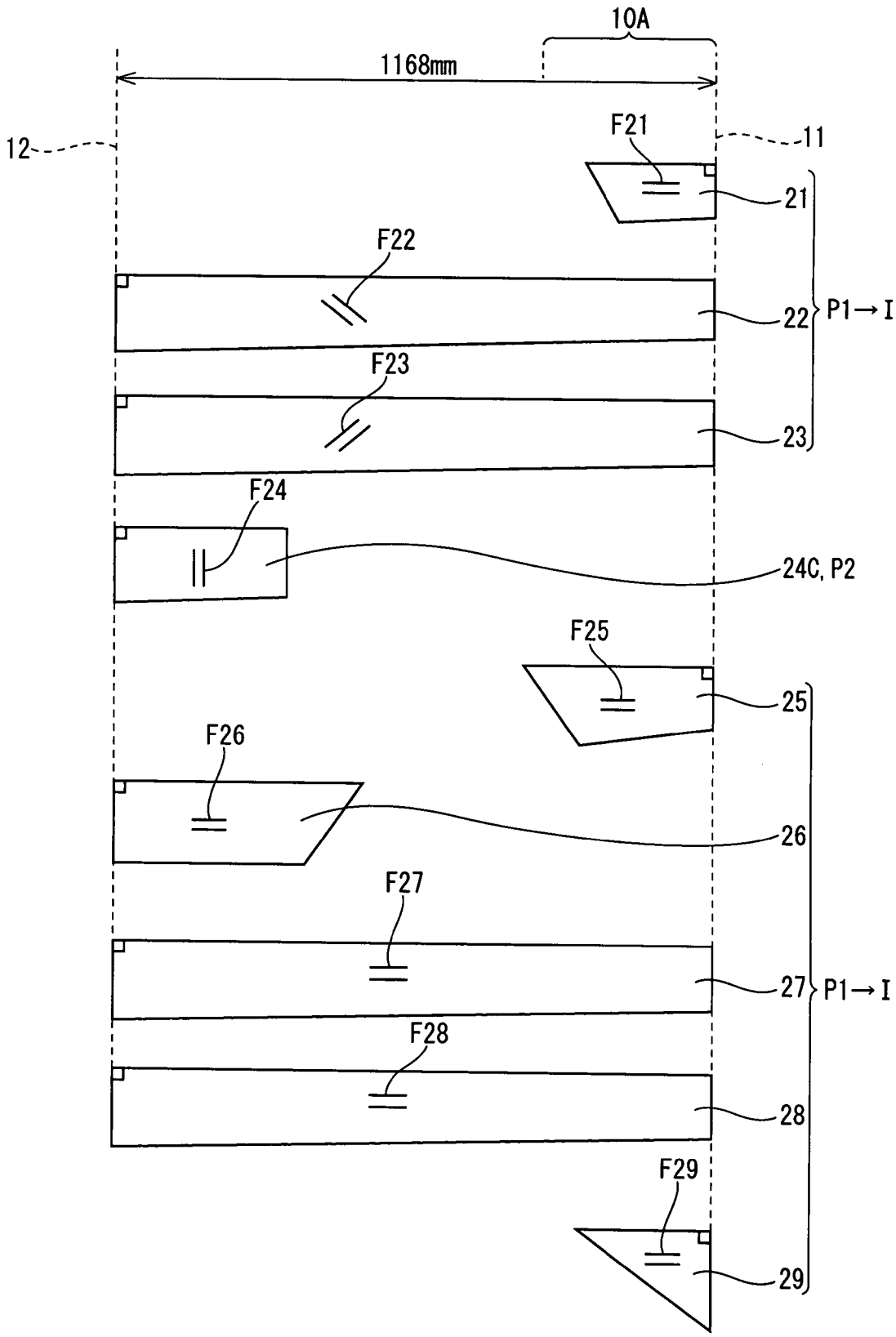
FIG. 4 shows a layered construction of fiber reinforced prepregs of a golf club shaft of a third embodiment.

FIG. 4 shows the third embodiment of the present invention. The second prepreg P2 is disposed at the grip-side butt of the shaft 10.

More specifically, a fiber reinforced prepreg 24C constructing the second prepreg P2 is disposed in a region spaced at an interval of 800 mm to 1168 mm (grip-side butt 12) from the head-side tip 11. The fiber reinforced prepreg 24C has a thickness of 0.0840 mm. The width of the fiber reinforced prepreg 24C is so set that the mandrel is wound with one turn thereof to form one layer. The reinforcing fiber F24 forms an angle of 90° to the axis of the shaft 10 and has a modulus of elasticity in tension of 30 tonf/mm$^2$.

The DL-26 produced by CCI Inc. for use in the prepreg 24A of the first embodiment is used as the matrix resin composition for use in the prepreg 24C constructing the second prepreg P2. The loss factor of the second prepreg P2 is set to 0.3.

The total weight of the shaft 10 is set to 60.5 g. The weight of the first laminate I is set to 58.0 g. The weight of the second prepreg P2 is set to 2.5 g which is about 4% of the weight of the first laminate I.

At the rear portion of the shaft 10 where the second prepreg P2 is disposed, 13 layers including 12 layers of the first laminate I and one layer of the second prepreg P2 are disposed. Only one layer of the second prepreg P2 is disposed at the seventh layer from the inner peripheral side of the shaft. The second prepreg P2 is entirely (100%) disposed inside the central region in the thickness direction of the shaft. The other constructions of the shaft of the third embodiment are identical to those of the shaft of the first embodiment.

In the third embodiment, because the second prepreg P2 is not disposed in the distal-side 30% region 10A of the shaft 10, the shaft of the third embodiment is inferior to that of the first embodiment in the vibration-absorbing performance. But the second prepreg P2 is entirely disposed in the central region in the thickness direction of the shaft to which a high shear force is applied. Thus the shaft of the third embodiment has an effective vibration-absorbing performance. Further the ratio of the weight of the second prepreg P2 to the weight of the first laminate I is set to 4%. Therefore the shaft of the third embodiment is capable of maintaining a necessary strength without increasing the weight thereof.

Figure 5:
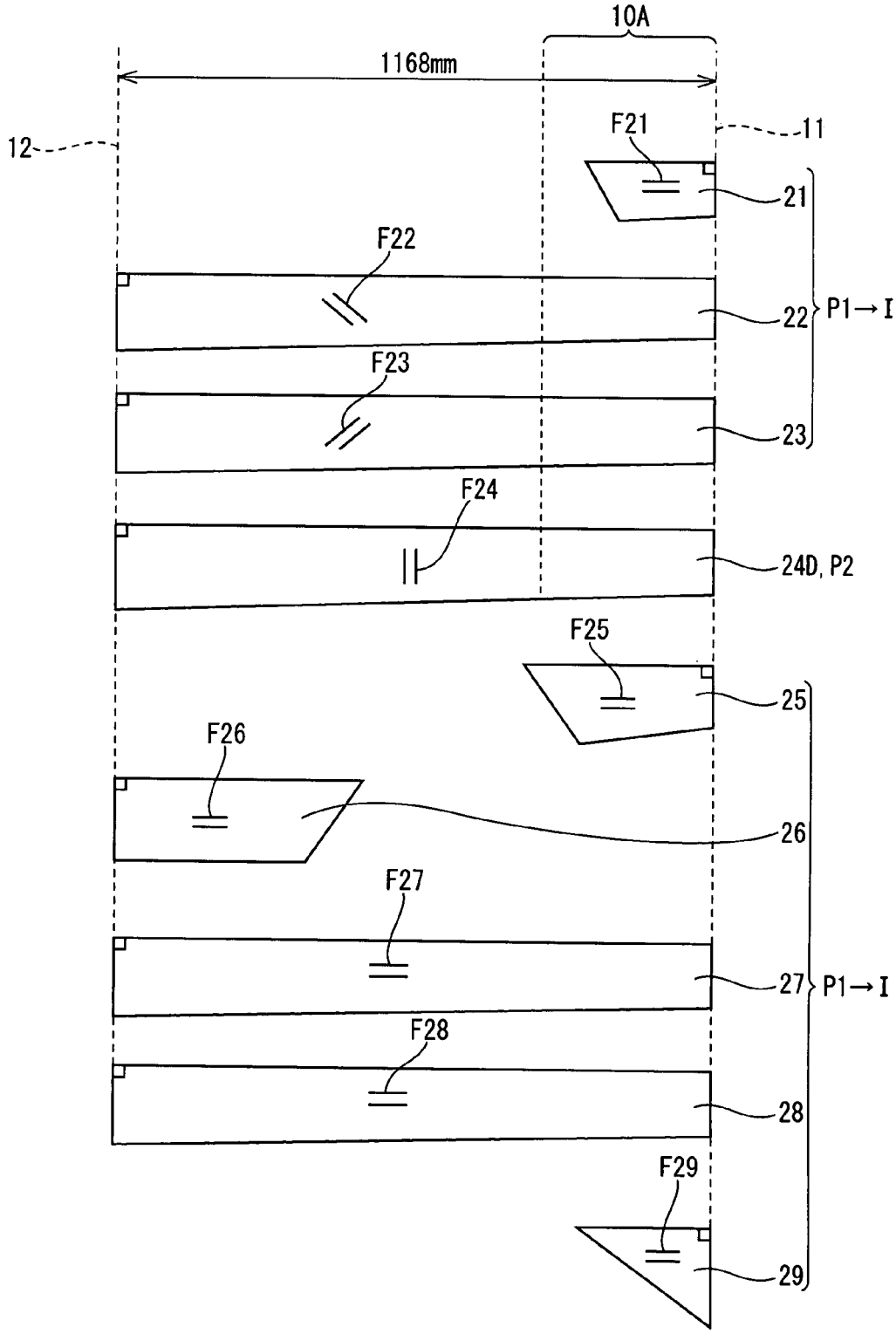
FIG. 5 shows a layered construction of fiber reinforced prepregs of a golf club shaft of a fourth embodiment.

FIG. 5 shows the fourth embodiment of the present invention. The second prepreg P2 is disposed over the full length of the shaft 10.

More specifically, a fiber reinforced prepreg 24D constructing the second prepreg P2 is disposed over the full length of the shaft 10. The fiber reinforced prepreg 24D has a thickness of 0.0840 mm. The width of the fiber reinforced prepreg 24D is so set that the mandrel is wound with one turn thereof to form one layer. The reinforcing fiber F24 forms an angle of 90° to the axis of the shaft 10 and has a modulus of elasticity in tension of 30 tonf/mm$^2$.

The DL-26 produced by CCI Inc. for use in the prepregs 24A through 24C of the above-described embodiments is also used as the matrix resin composition for use in the prepreg 24D. The loss factor of the second prepreg P2 is set to 0.3.

The total weight of the shaft 10 is set to 64 g. The weight of the first laminate I is set to 58.0 g. The weight of the second prepreg P2 is set to 6.0 g which is about 10% of the weight of the first laminate I.

At the tip side of the shaft 10, 21 layers including 20 layers of the first laminate I and one layer of the second prepreg P2 are disposed. Only one layer of the second prepreg P2 is disposed at the tenth layer from the inner peripheral side of the shaft. At the rear side of the shaft 10, 13 layers including 12 layers of the first laminate I and one layer of the second prepreg P2 are disposed. Only one layer of the second prepreg P2 is disposed at the seventh layer from the inner peripheral side of the shaft.

The second prepreg P2 is entirely (100%) disposed inside the central region in the thickness direction of the shaft, with the second prepreg P2 extended over the full length of the shaft.

The other constructions of the shaft of the third embodiment are the same as those of the shaft of the first embodiment.

In the fourth embodiment, because the second prepreg P2 is disposed over the full length of the shaft 10, including the distal-side 30% region 10A, the shaft of the fourth embodiment has an excellent vibration-absorbing performance. Further the ratio of the weight of the second prepreg P2 to the weight of the first laminate I is set to 10%. Therefore the shaft of the fourth embodiment is capable of maintaining a necessary strength without increasing the weight thereof.

Golf club shafts of examples 1 through 12 and comparison examples 1 through 4 having the above-described construction will be described below. Although the effect of the present invention is clarified, the present invention should not be limitedly understood based on the description of the examples.

As shown in tables 1 and 2, shafts of examples 1 through 11 and comparison examples 1 through 4 were formed by differentiating the loss factor of the first laminate I; the loss factor of the second prepreg P2; the laminated construction of the prepregs; and the weights, number of layers, laminated positions, fibrous angles, and positions (distance from head-side tip of shaft) of the second prepreg P2. The grip-side flexure, vibration-damping factor (out-of-plane primary vibration-damping factor), three-point bending strength of each of the shafts were measured. Further evaluations of the vibration and vibration-absorbing performance of each shaft were made by hitting golf balls. Table 1 shows the results.

TABLE 1

| | | Example ① | Example ② | Example ③ | Example ④ |
|---|---|---|---|---|---|
| Modified resin | Tanδ(10 Hz, 10° C.) of first laminate | 0.01 | 0.01 | 0.01 | 0.01 |
| | Number of prepregs of first laminate | | ㉑ ㉒ ㉓ ㉔ ㉕ ㉖ ㉗ ㉘ ㉙ | | |
| | Tanδ(10 Hz, 10° C.) of second prepreg | 0.3 | 0.3 | 0.3 | 0.3 |
| | Number of second prepreg | ㉔A | ㉔B | ㉔C | ㉔A-C |
| | Weight(g) of second prepreg -A | 1.5 | 2 | 2.5 | 6 |
| | Weight(g) of second prepreg disposed at range of 30% to 70% of thickness -B | 1.5 | 2 | 2.5 | 6 |
| | (B/A) × 100(%) | 100 | 100 | 100 | 100 |
| | Weight % (second prepreg Wt/first prepreg Wt) | 2% | 3% | 4% | 10% |
| | Number of layers of first prepreg | 20 10 | 20 12 | 20 12 | 20 12 |
| | Number of layers of second prepreg | 1 ... | ... 1 | ... 1 | 1 1 |
| | Laminated position of second prepreg | 10th layer ... | ... 7th layer | ... 7th layer | 10th layer 7th layer |

TABLE 1-continued

| | | | | | | |
|---|---|---|---|---|---|---|
| | Fibrous angle of second prepreg | | 90 | 90 | 90 | 90 |
| | Position of second prepreg (distance from head-side tip of shaft) [cm] | | 0-400 | 400-800 | 800-1168 | 0-1168 |
| Item | Weight of shaft [g] | | 59.5 | 60 | 60.5 | 64 |
| | Center of gravity of shaft [mm] (distance from head-side tip of shaft) | | 598 | 600 | 603 | 600 |
| | Grip-side flexure [mm] | | 105 | 104 | 104 | 103 |
| | Vibration-damping factor [%] | | 0.70 | 0.61 | 0.65 | 0.91 |
| Strength | Three-point bending strength | Strength at point A [kgf] | 87 | 84 | 83 | 87 |
| | | Strength at point B [kgf] | 95 | 100 | 94 | 101 |
| | | Strength at point C [kgf] | 132 | 134 | 140 | 141 |
| | Impact energy [J] | | 3.81 | 3.52 | 3.53 | 3.88 |
| Evaluation by hitting ball | Vibration & impact | | 3.8 | 3.7 | 3.7 | 4.0 |

| | | | Example ⑤ | | Example ⑥ |
|---|---|---|---|---|---|
| Modified resin | Tanδ(10 Hz, 10° C.) of first laminate | | 0.01 | | 0.01 |
| | Number of prepregs of first laminate | | ㉑ ㉒ ㉓ ㉔ ㉗ ㉘ ㉚ | | ㉑ ㉒ ㉓ ㉕ ㉗ ㉘ ㉙ |
| | Tanδ(10 Hz, 10° C.) of second prepreg | | 0.3 | | 0.3 |
| | Number of second prepreg | | ㉖ | | ㉖ |
| | Weight(g) of second prepreg -A | | 4.5 | | 7.5 |
| | Weight(g) of second prepreg disposed at range of 30% to 70% of thickness -B | | 4.5 | | 6 |
| | (B/A) × 100(%) | | 100 | | 80 |
| | Weight % (second prepreg Wt/first prepreg Wt) | | 8% | | 14% |
| | Number of layers of first prepreg | | 17 | 12 | 20 9 |
| | Number of layers of second prepreg | | 3 | . . . | . . . 3 |
| | Laminated position of second prepreg | | 10th to 12th layer | . . . | . . . 7th to 9th layer |
| | Fibrous angle of second prepreg | | 0 | | 0 |
| | Position of second prepreg (distance from head-side tip of shaft) [cm] | | 0-400 | | 800-1168 |
| Item | Weight of shaft [g] | | 58 | | 58 |
| | Center of gravity of shaft [mm] (distance from head-side tip of shaft) | | 600 | | 600 |
| | Grip-side flexure [mm] | | 105 | | 107 |
| | Vibration-damping factor [%] | | 1.05 | | 0.86 |
| Strength | Three-point bending strength | Strength at point A [kgf] | 80 | | 83 |
| | | Strength at point B [kgf] | 93 | | 91 |
| | | Strength at point C [kgf] | 133 | | 130 |
| | Impact energy [J] | | 4.13 | | 3.55 |
| Evaluation by hitting ball | Vibration & impact | | 4.3 | | 4.0 |

| | | | Example ⑦ | | Example ⑧ | | Example ⑨ | |
|---|---|---|---|---|---|---|---|---|
| Modified resin | Tanδ(10 Hz, 10° C.) of first laminate | | 0.01 | | 0.01 | | 0.02 | |
| | Number of prepregs of first laminate | | ㉑ ㉒ ㉓ ㉕ ㉖ ㉗ ㉘ ㉙ | | | | | |
| | Tanδ(10 Hz, 10° C.) of second prepreg | | 0.1 | | 0.5 | | 0.3 | |
| | Number of second prepreg | | ㉓A | | | | | |
| | Weight(g) of second prepreg -A | | 1.5 | | 1.5 | | 1.5 | |
| | Weight(g) of second prepreg disposed at range of 30% to 70% of thickness -B | | 1.5 | | 1.5 | | 1.5 | |
| | (B/A) × 100(%) | | 100 | | 100 | | 100 | |
| | Weight % (second prepreg Wt/first prepreg Wt) | | 2% | | 2% | | 2% | |
| | Number of layers of first prepreg | | 20 | 12 | 20 | 12 | 20 | 12 |
| | Number of layers of second prepreg | | 1 | . . . | 1 | . . . | 1 | . . . |
| | Laminated position of second prepreg | | 10th layer | . . . | 10th layer | . . . | 10th layer | . . . |
| | Fibrous angle of second prepreg | | 90 | | 90 | | 90 | |
| | Position of second prepreg (distance from head-side tip of shaft) [cm] | | 0-400 | | 0-400 | | 0-400 | |
| Item | Weight of shaft [g] | | 59.5 | | 59.5 | | 59.6 | |
| | Center of gravity of shaft [mm] (distance from head-side tip of shaft) | | 598 | | 597 | | 598 | |
| | Grip-side flexure [mm] | | 105 | | 105 | | 105 | |
| | Vibration-damping factor [%] | | 0.65 | | 0.92 | | 0.88 | |

TABLE 1-continued

| | | | | | |
|---|---|---|---|---|---|
| Strength | Three-point bending strength | Strength at point A [kgf] | 83 | 80 | 80 |
| | | Strength at point B [kgf] | 94 | 93 | 90 |
| | | Strength at point C [kgf] | 133 | 132 | 131 |
| | Impact energy [J] | | 3.65 | 3.90 | 4.01 |
| Evaluation by hitting ball | Vibration & impact | | 3.8 | 4.1 | 4.0 |

TABLE 2

| | | | CE ① | Example ⑩ | Example ⑪ |
|---|---|---|---|---|---|
| Modified resin | Tanδ(10 Hz, 10° C.) of first laminate | | 0.01 | 0.01 | 0.01 |
| | Number of prepregs of first laminate | | | ㉑ ㉒ ㉓ ㉕ ㉖ ㉗ ㉘ ㉙ | |
| | Tanδ(10 Hz, 10° C.) of second prepreg | | . . . | 0.3 | 0.3 |
| | Number of second prepreg | | . . . | ㉔ C | |
| | Weight(g) of second prepreg -A | | . . . | 3 | 2 |
| | Weight(g) of second prepreg disposed at range of 30% to 70% of thickness -B | | . . . | 0 | 0 |
| | (B/A) × 100(%) | | . . . | 0 | 0 |
| | Weight % (second prepreg Wt/first prepreg Wt) | | . . . | 5% | 3% |
| | Number of layers of first prepreg | | 20 12 | 20 12 | 20 12 |
| | Number of layers of second prepreg | | . . . | . . . 1 | . . . 1 |
| | Laminated position of second prepreg | | . . . | 12th layer | . . . 2nd layer |
| | Fibrous angle of second prepreg | | . . . | 90 | 90 |
| | Position of second prepreg (distance from head-side tip of shaft) [cm] | | . . . | 800-1168 | 800-1168 |
| Item | Weight of shaft [g] | | 58 | 61 | 60 |
| | Center of gravity of shaft [mm] (distance from head-side tip of shaft) | | 600 | 604 | 602 |
| | Grip-side flexure [mm] | | 105 | 100 | 104 |
| | Vibration-damping factor [%] | | 0.35 | 0.48 | 0.42 |
| Strength | Three-point bending strength | Strength at point A [kgf] | 84 | 82 | 83 |
| | | Strength at point B [kgf] | 95 | 93 | 94 |
| | | Strength at point C [kgf] | 133 | 115 | 128 |
| | Impact energy [J] | | 3.50 | 3.51 | 3.50 |
| Evaluation by hitting ball | Vibration & impact | | 2.5 | 3.1 | 3.0 |

| | | | CE ② | CE ③ | CE ④ |
|---|---|---|---|---|---|
| Modified resin | Tanδ(10 Hz, 10° C.) of first laminate | | 0.01 | 0.01 | 0.05 |
| | Number of prepregs of first laminate | | | ㉑ ㉒ ㉓ ㉔ ㉖ ㉗ ㉘ ㉙ | |
| | Tanδ(10 Hz, 10° C.) of second prepreg | | 0.05 | 0.7 | 0.3 |
| | Number of second prepreg | | | ㉔ A | |
| | Weight(g) of second prepreg -A | | 1.5 | 1.5 | 1.5 |
| | Weight(g) of second prepreg disposed at range of 30% to 70% of thickness -B | | 1.5 | 1.5 | 1.5 |
| | (B/A) × 100(%) | | 100 | 100 | 100 |
| | Weight % (second prepreg Wt/first prepreg Wt) | | 2% | 2% | 2% |
| | Number of layers of first prepreg | | 20 12 | 20 12 | 20 12 |
| | Number of layers of second prepreg | | 1 . . . | 1 . . . | 1 . . . |
| | Laminated position of second prepreg | | 10th layer . . . | 10th layer . . . | 10th layer . . . |
| | Fibrous angle of second prepreg | | 90 | 90 | 90 |
| | Position of second prepreg (distance from head-side tip of shaft) [cm] | | 0-400 | 0-400 | 0-400 |
| Item | Weight of shaft [g] | | 59.6 | 59.5 | 59.6 |
| | Center of gravity of shaft [mm] (distance from head-side tip of shaft) | | 600 | 600 | 600 |
| | Grip-side flexure [mm] | | 105 | 105 | 105 |
| | Vibration-damping factor [%] | | 0.40 | 1.03 | 1.10 |
| Strength | Three-point bending strength | Strength at point A [kgf] | 85 | 69 | 72 |
| | | Strength at point B [kgf] | 95 | 90 | 80 |
| | | Strength at point C [kgf] | 130 | 130 | 115 |
| | Impact energy [J] | | 3.23 | 3.95 | 3.76 |
| Evaluation by hitting ball | Vibration & impact | | 2.8 | 4.3 | 4.5 |

CE in the uppermost column indicate comparison example.

The shafts of examples 1 through 12 and comparison examples 1 through 4 were formed by using the sheet winding method similarly to the above-described embodiments. The weight and center of gravity of the shaft were set as shown in table 1. The lengths of the shafts were equally set to 1,168 mm.

EXAMPLE 1

The shaft of the example 1 had the same construction as that of the shaft of the first embodiment.

More specifically, the second prepreg P2 had a loss factor of 0.3. The second prepreg P2 was disposed in a region of 400 mm from the head-side tip of the shaft. The weight of the second prepreg P2 was set to 1.5 g which was 2% of the first laminate I. The number of layers of the second prepreg P2 was one. The fibrous angle of the reinforcing fiber was set to 90°. The second prepreg P2 was disposed at the tenth layer from the inner peripheral side of the shaft having 21 layers. A second laminate (second prepreg) II was entirely (100%) disposed inside the central region in the thickness direction of the shaft.

The loss factor of the first laminate I was set to 0.01.

Each of the fiber reinforced prepregs constructing the shaft is as described below.

Prepregs produced by Toray Industries Inc. was used to compose each of the first prepregs P1. A prepreg having a article number "3255G-12" (kind of fiber: T700, modulus of elasticity in tension: 24 tonf/mm$^2$, thickness: 0.1030 mm) was used as the prepreg 21. A prepreg having a article number "9255G-1" (kind of fiber: M40J, modulus of elasticity in tension: 40 tonf/mm$^2$, thickness: 0.0820 mm) was used as the prepregs 22, 23. A prepreg having a article number "3255G-10" (kind of fiber: T700, modulus of elasticity in tension: 24 tonf/mm$^2$, thickness: 0.0840 mm) was used as the prepreg 25. A prepreg having a article number "3255G-10" (kind of fiber: T700, modulus of elasticity in tension: 24 tonf/mm$^2$, thickness: 0.0840 mm) was used as the prepreg 25. A prepreg having a article number "2255F-10" (kind of fiber: T800, modulus of elasticity in tension: 30 tonf/mm$^2$, thickness: 0.0840 mm) was used as the prepreg 26. A prepreg having a article number "2255F-15" (kind of fiber: T800, modulus of elasticity in tension: 30 tonf/mm$^2$, thickness: 0.1450 mm) was used as the prepregs 27, 28. A prepreg having a article number "3255F-12" (kind of fiber: T700, modulus of elasticity in tension: 24 tonf/mm$^2$, thickness: 0.1030 mm) was used as the prepreg 29.

A prepreg, having a thickness of 0.0840 mm, which contained a matrix resin composition (article number: DL-26) produced by CCI Inc. and carbon fiber (kind of fiber: T800, modulus of elasticity in tension: 30 tonf/mm$^2$) impregnated the matrix resin composition was used as the second prepreg P2, namely, the prepreg 24A.

EXAMPLE 2

The shaft of the example 2 had the same construction as that of the shaft of the second embodiment.

More specifically, the second prepreg P2 was disposed in a region spaced at an interval of 400 mm to 800 mm from the head-side tip 11. The weight of the second prepreg P2 was 2.0 g which was 3% of the first laminate I. The second prepreg P2 was disposed at the seventh layer from the inner peripheral side of the shaft having 13 layers. The second laminate II was entirely (100%) disposed inside the central region in the thickness direction of the shaft.

Other constructions and prepreg used were identical to those of the shaft of the example 1. The loss factor of the first laminate I and the second prepreg P2 were set to 0.01 and 0.3 respectively.

EXAMPLE 3

The shaft of the example 3 had the same construction as that of the shaft of the third embodiment.

More specifically, the second prepreg P2 was disposed in a region spaced at an interval of 800 mm to 1168 mm from the head-side tip 11. The weight of the second prepreg P2 was set to 2.5 g which was 4% of the first laminate I. The second prepreg P2 was disposed at the seventh layer from the inner peripheral side of the shaft having 13 layers. The second prepreg P2 was entirely (100%) disposed inside the central region in the thickness direction of the shaft.

Other constructions and prepregs of the shaft were identical to those of the shaft of the example 1. The loss factor of the first laminate I and that of the second prepreg were set to 0.01 and 0.3 respectively.

EXAMPLE 4

The shaft of the example 4 had the same construction as that of the shaft of the fourth embodiment.

More specifically, the second prepreg P was disposed over the full length of the shaft 10. The weight of the second prepreg P2 was set to 6.0 g which was 10% of the first laminate I. At the tip side of the shaft 10, the second prepreg P2 was disposed at the tenth layer from the inner peripheral side of the shaft having 21 layers. At the rear side of the shaft 10, the second prepreg P2 was disposed at the seventh layer from the inner peripheral side of the shaft having 13 layers. The second prepreg P2 was entirely (100%) disposed inside the central region in the thickness direction of the shaft.

Other constructions and prepregs of the shaft were identical to those of the shaft of the example 1. The loss factor of the first laminate I and the second prepreg were set to 0.01 and 0.3 respectively.

EXAMPLE 5

Figure 6:
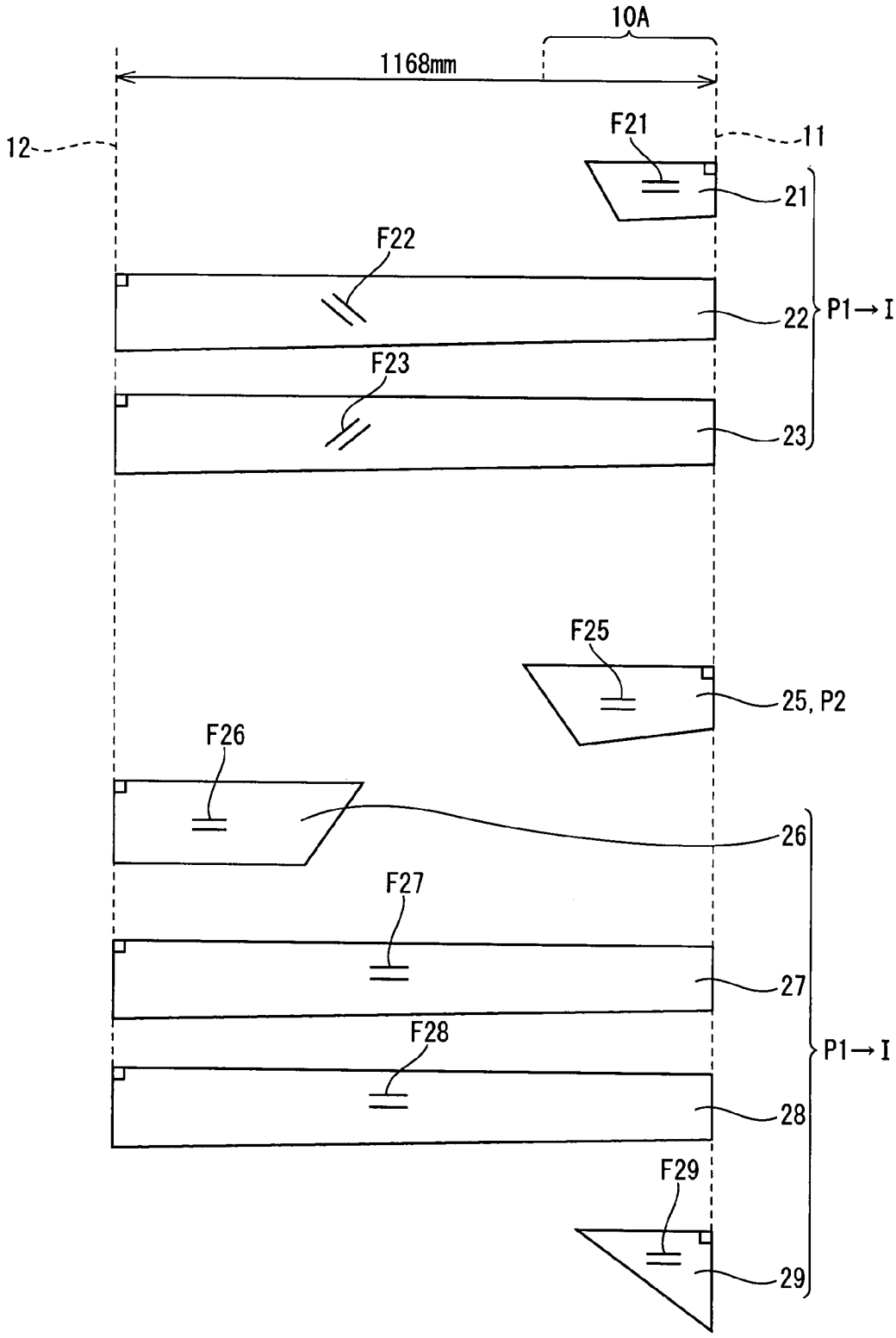
FIG. 6 shows a layered construction of fiber reinforced prepregs of a golf club shaft of an example 5.

The shaft had a laminated construction shown in FIG. 6. That is, the construction of the shaft of the example 5 was different from that of the shafts of the examples 1 through 4 in that any of the prepregs 24A, 24B, 24C, and 24D was not used, but the prepreg 25 which was a straight layer was used as the second prepreg P2.

More specifically, the fibrous angle of the second prepreg P2 consisting of the prepreg 25 was set to 0°. The second prepreg P2 was disposed in a region within 367 mm from the head-side tip of the shaft. The weight of the second prepreg P2 was 4.5 g which was 8% of the first laminate I. The number of layers of the second prepreg P2 was three. The second prepreg P2 was disposed at the tenth layer to the twelfth layer from the inner peripheral side of the shaft having 20 layers. The second prepreg P2 was entirely (100%) disposed inside the central region in the thickness direction of the shaft. The second prepreg P2 and the first laminate I had a loss factor of 0.3 and 0.01 respectively.

A prepreg, having a thickness of 0.0840 mm, which contained the matrix resin composition (article number: DL-26) produced by CCI Inc. and carbon fiber (kind of fiber: T700, modulus of elasticity in tension: 24 tonf/mm$^2$) impregnated with the matrix resin composition was used as the prepreg 25.

Other constructions of the shaft and the prepreg used therefor were identical to those of the shaft of the example 1.

EXAMPLE 6

Figure 7:
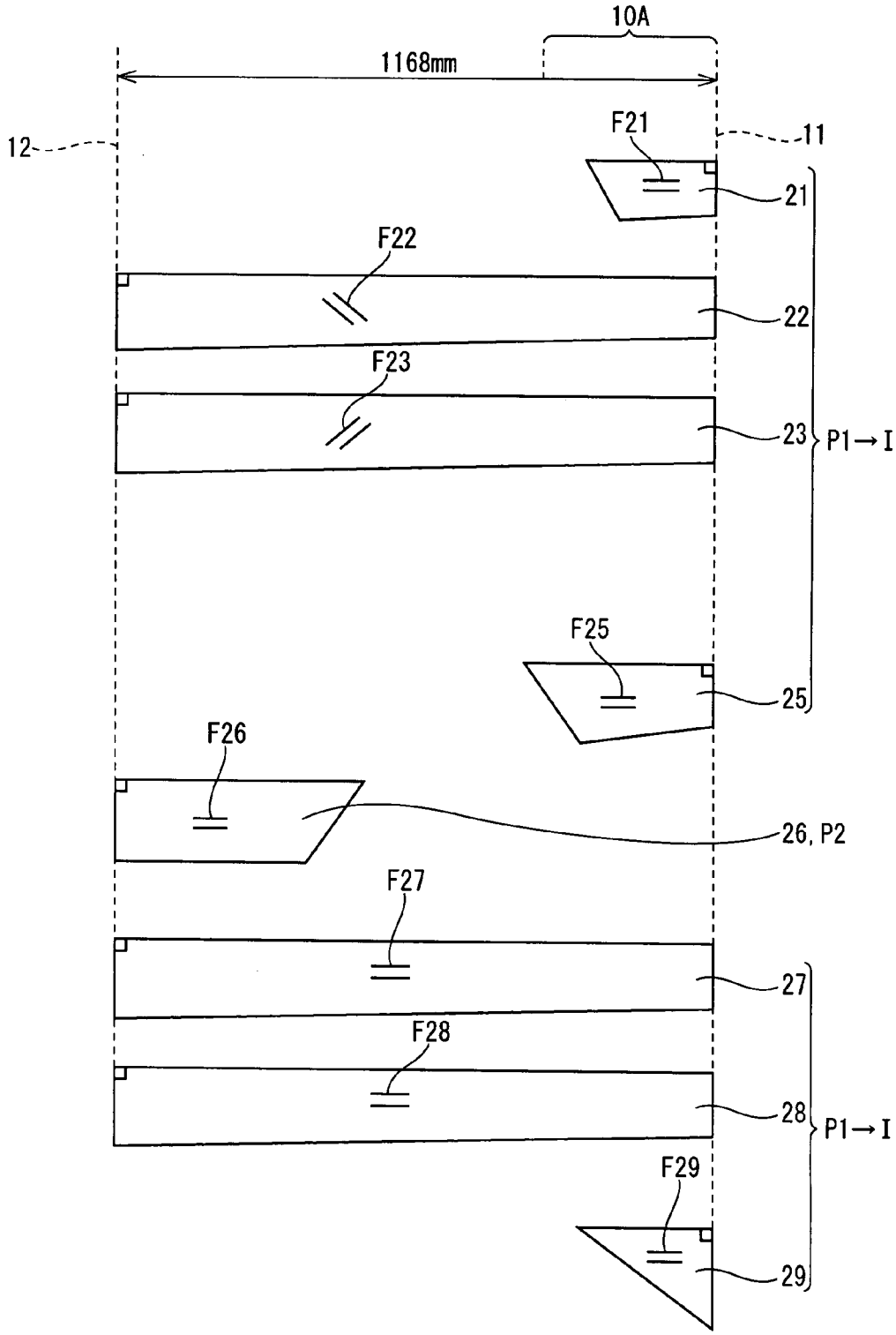
FIG. 7 shows a layered construction of fiber reinforced prepregs of a golf club shaft of an example 6.

The shaft had a laminated construction shown in FIG. 7. That is, the construction of the shaft of the example 6 was different from that of the shafts of the example 5 in that the prepreg 25 was used as the first prepreg P1 and that the prepreg 26 was used as the second prepreg P2.

More specifically, the fibrous angle of the second prepreg P2 consisting of the prepreg 26 was set to 0°. The second prepreg P2 was disposed in a region within 453 mm from the grip-side butt of the shaft. The weight of the second prepreg P2 was 7.5 g which was 14% of the first laminate I. The number of layers of the second prepreg P2 was three. The second prepreg P2 was disposed at the seventh layer to the ninth layer from the inner peripheral side of the shaft having 12 layers. 6 g corresponding to 80% of the second prepreg P2 was disposed inside the central region in the thickness direction of the shaft. The second prepreg P2 and the first laminate I had a loss factor of 0.3 and 0.01 respectively.

A prepreg, having a thickness of 0.0840 mm, which contained the matrix resin composition (article number: DL-26) produced by CCI Inc. and carbon fiber (kind of fiber: T800, modulus of elasticity in tension: 30 tonf/mm$^2$) impregnated with the matrix resin composition was used as the prepreg 25. Other constructions of the shaft and the prepreg used therefor were identical to those of the shaft of the example 1.

EXAMPLE 7

The shaft of the example 7 had the same laminated construction as that of the shaft of the example 1, but was different therefrom in that the loss factor of the second prepreg P2 of the shaft of the example 7 was set to 0.1.

More specifically, the prepreg 24A composing the second prepreg P2 was formed by impregnating carbon fiber (kind of fiber: T800, modulus of elasticity in tension: 30 tonf/mm$^2$) with a resin composition composed of the matrix resin composition (article number: DL-26) produced by CCI Inc. and epoxy resin mixed with the matrix resin composition at a ratio of 1:2. The prepreg 24A had a thickness of 0.0840 mm.

Other constructions of the shaft and the prepreg used therefor were identical to those of the shaft of the example 1.

EXAMPLE 8

The shaft of the example 8 had the same laminated construction as that of the shaft of the example 1, but was different therefrom in that the loss factor of the second prepreg P2 of the shaft of the example 8 was set to 0.5.

More specifically, the prepreg 24A composing the second prepreg P2 was formed by impregnating carbon fiber (kind of fiber: T800, viscoelasticity-measuring apparatus: 30 tonf/mm$^2$) with a resin composition composed of the matrix resin compositions "DL-26" and "DL-27", both produced by CCI Inc., which were mixed with each other at a ratio of 1:1. The prepreg 24A had thickness of 0.0840 mm. Other constructions of the shaft and the prepreg used therefor were identical to those of the shaft of the example 1.

EXAMPLE 9

The shaft of the example 9 had the same laminated construction as that of the shaft of the example 1, but was different therefrom in that the loss factor of the first laminate I of the example 9 was set to 0.02.

More specifically, as the prepregs 21 through 23 and 25 through 29 composing the first laminate I was formed by mixing the matrix resin composition "DL-26" produced by CCI Inc. and the epoxy resin with each other at a ratio of 1:100. The thickness of each prepreg and the modulus of elasticity in tension of each reinforcing fiber used for each prepreg were equal to those of the shaft of the example 1. The kind of the reinforcing fiber used for each prepreg was the same as that of the shaft of the example 1. The second prepreg P2 was the same as that of the shaft of the example 1.

EXAMPLE 10

Figure 8:
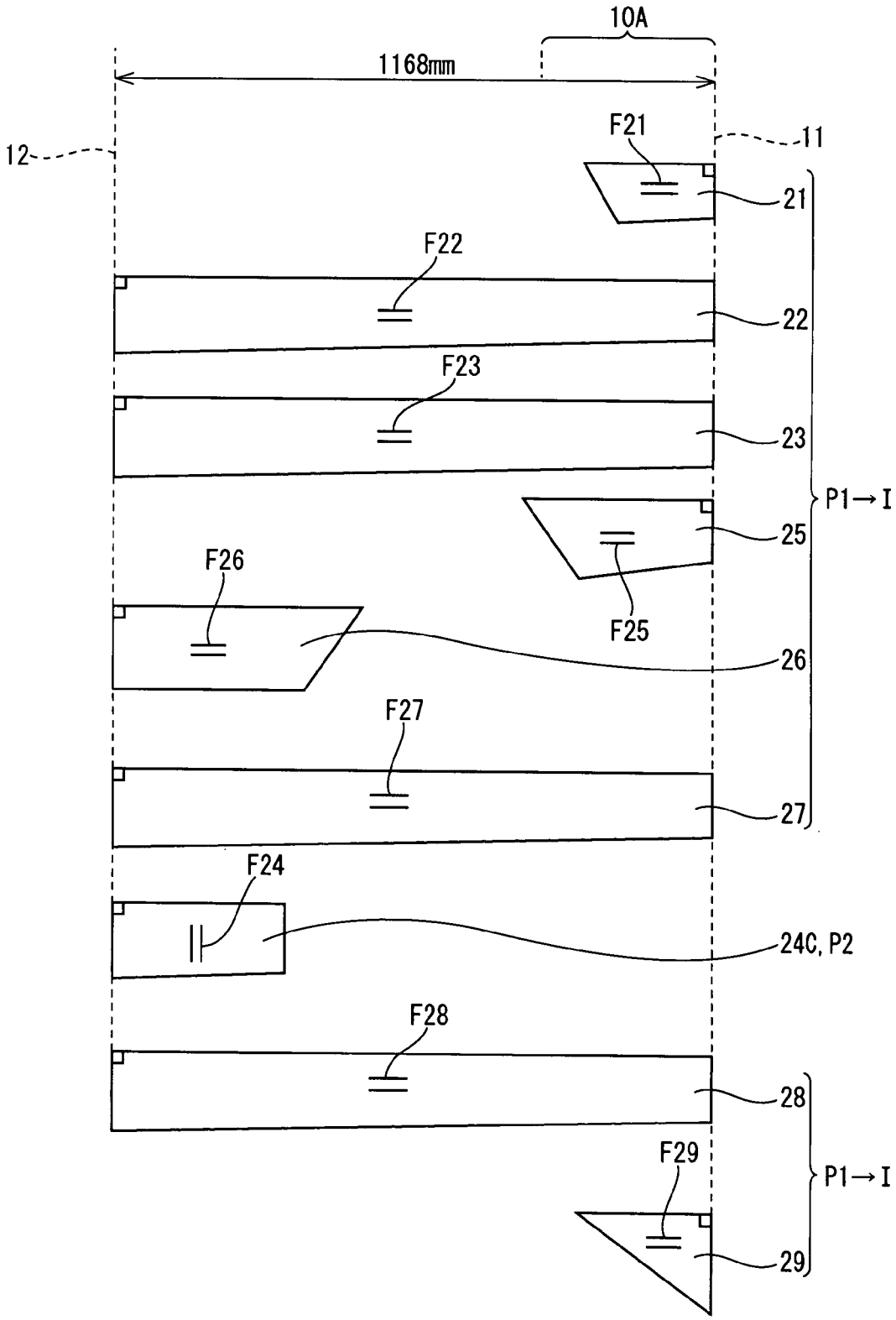
FIG. 8 shows a layered construction of fiber reinforced prepregs of a golf club shaft of an example 11.

The shaft had a laminated construction shown in FIG. 8. The construction of the shaft of the example 6 was different from that of the shaft of the example 3 in that the prepreg 24C composing the second prepreg P2 was interposed between the prepregs 27 and 28.

More specifically, the fibrous angle of the reinforcing fiber of the second prepreg P2 consisting of the prepreg 24C was set to 90°. The second prepreg P2 was disposed in a region spaced at an interval of 800 mm to 1168 mm from the head-side tip 11. The weight of the second prepreg P2 was 3.0 g which was 5% of the first laminate I. The second prepreg P2 was disposed at the twelfth layer from the inner peripheral side of the shaft having 13 layers. The second prepreg P2 was not disposed inside the central region in the thickness direction of the shaft. The loss factor of the second prepreg P2 was set to 0.3.

Of the first laminate I, a prepreg "9255G-7" (kind of fiber: M40J, modulus of elasticity in tension: 40 tonf/mm$^2$, thickness: 0.0570 mm) produced by Toray Industries Inc. was used as the prepregs 22, 23. A prepreg "3255G-12" (kind of fiber: T700, was used as the prepreg 21. A prepreg having a article number "9255G-10" (kind of fiber: T700, modulus of elasticity in tension: 24 tonf/mm$^2$, thickness: 0.0840 mm) was used as the prepreg 29. The loss factor of the first laminate I was set to 0.01. Other constructions of the shaft and the prepreg used therefor were identical to those of the shaft of the example 3.

EXAMPLE 11

Figure 9:
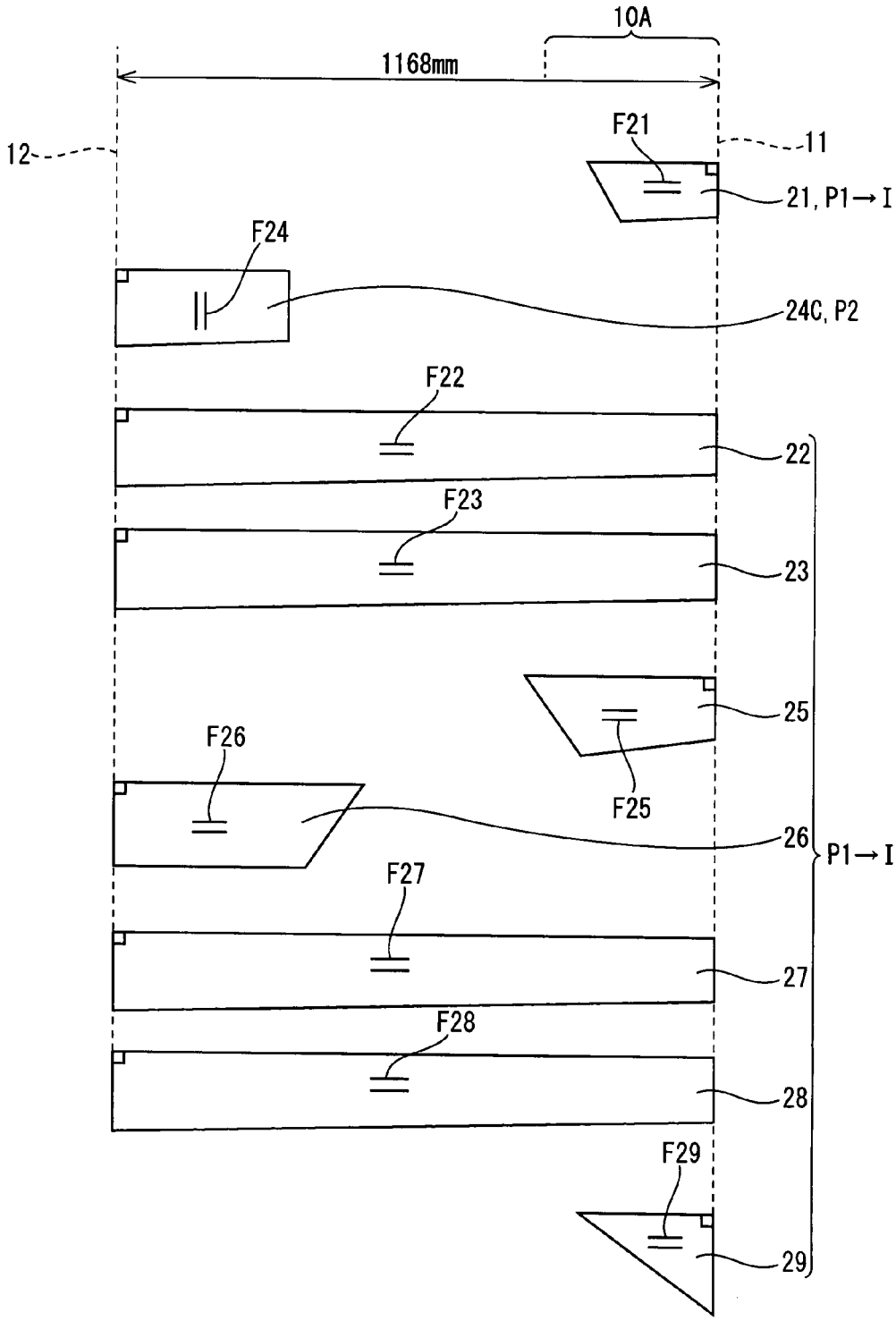
FIG. 9 shows a layered construction of fiber reinforced prepregs of a golf club shaft of an example 12.

The shaft had a laminated construction shown in FIG. 9. The construction of the shaft of the example 11 was different from that of the shafts of the example 3, 10 in that the prepreg 24C composing the second prepreg P2 was interposed between the prepregs 21 and 22 by winding the prepreg 24C bonded to the inner peripheral surface of the prepreg 22.

More specifically, the fibrous angle of the reinforcing fiber of the second prepreg P2 consisting of the prepreg 24C was set to 90°. The second prepreg P2 was disposed in a region spaced at an interval of 800 mm to 1168 mm from the head-side tip 11. The weight of the second prepreg P2 was 2.0 g which was 3% of the first laminate I. The second prepreg P2 was disposed at the second layer from the inner peripheral side of the shaft having 13 layers. The second prepreg P2 was not disposed inside the central region in the thickness direction of the shaft. The loss factor of the second prepreg P2 was set to 0.3 and the loss factor of the first laminate I was set to 0.01. Other constructions of the shaft and the prepreg used therefor were identical to those of the shaft of the example 10.

COMPARISON EXAMPLE 1

Figure 10:
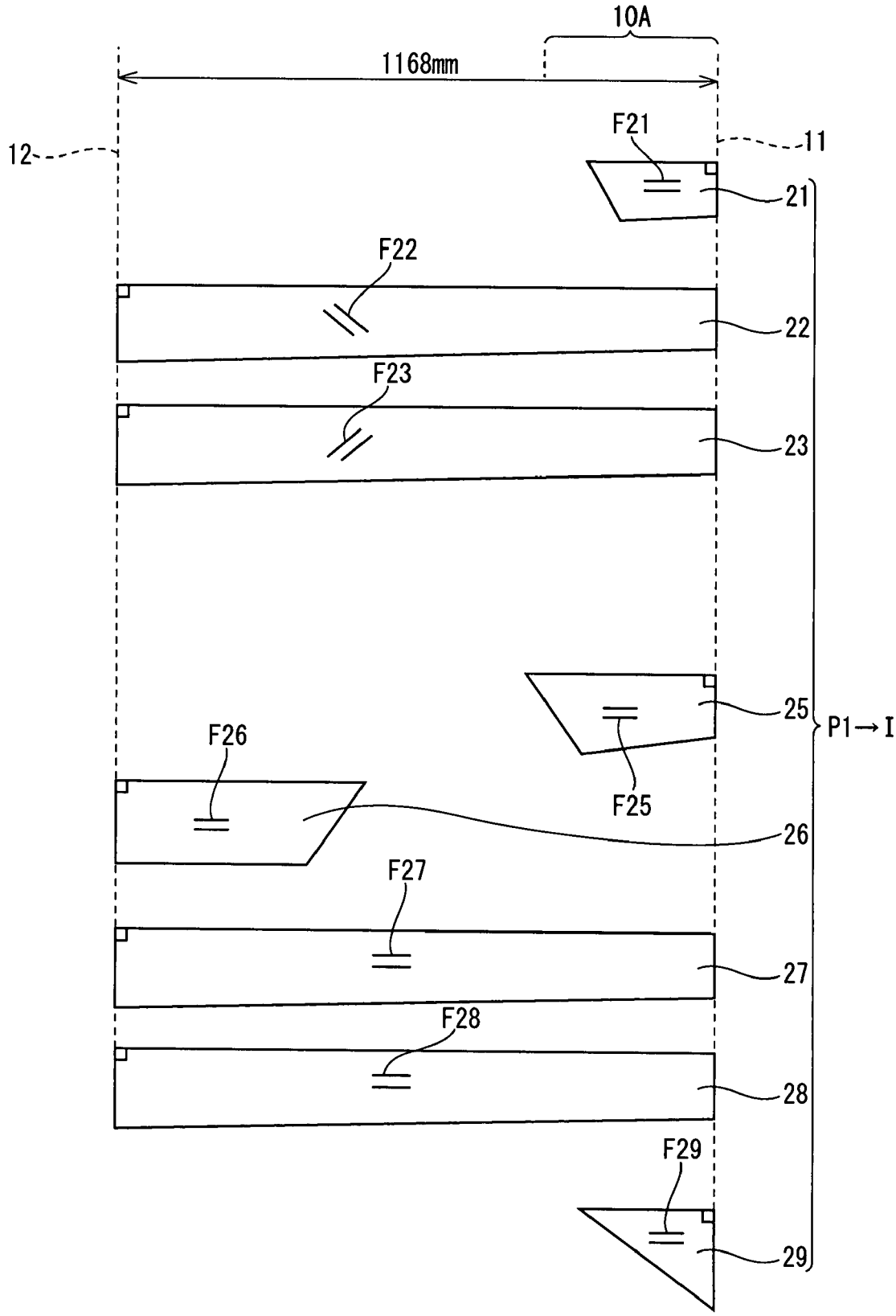
FIG. 10 shows a layered construction of fiber reinforced prepregs of a golf club shaft of a comparison example 1.

The shaft had a laminated construction shown in FIG. 10.

More specifically, the second prepreg P2 was not formed, but only the first laminate I was formed with the prepregs 21 through 23 and 25 through 29. Other constructions of the shaft and the prepreg used therefor were identical to those of the shaft of the example 1.

COMPARISON EXAMPLE 2

The shaft of the comparison example 2 had the same laminated construction as that of the shaft of the example 1 shown in FIG. 2, but was different therefrom in that the loss factor of the second prepreg P2 of the shaft of the comparison example 2 was set to 0.05.

More specifically, the prepreg 24A composing the second prepreg P2 was formed by impregnating carbon fiber (kind of fiber: T800, modulus of elasticity in tension: 30 tonf/mm$^2$) with a resin composition composed of the matrix resin composition (article number: DL-26) produced by CCI Inc. and epoxy resin mixed with the matrix resin composition at a ratio of 1:6. The prepreg 24A had a thickness of 0.0840 mm.

The prepreg "9255G-7" (kind of fiber: M40J, modulus of elasticity in tension: 40 tonf/mm$^2$, thickness: 0.0570 mm) produced by Toray Industries Inc. was used as the prepregs 22, 23. A prepreg "3255G-12" (kind of fiber: T700, was used as the prepreg 21. A prepreg having a article number "9255G-10" (kind of fiber: T700, modulus of elasticity in tension: 24 tonf/mm$^2$, thickness: 0.0840 mm) was used as the prepreg 29. Other constructions of the shaft and the prepreg used therefor were identical to those of the shaft of the example 1.

COMPARISON EXAMPLE 3

The shaft of the comparison example 3 had the same laminated construction as that of the shaft of the example 1 shown in FIG. 2, but was different therefrom in that the loss factor of the second prepreg P2 of the shaft of the comparison example 3 was set to 0.7.

More specifically, the prepreg 24A composing the second prepreg P2 was formed by impregnating the carbon fiber (kind of fiber: T800, modulus of elasticity in tension: 30 tonf/mm$^2$) with the matrix resin composition (article number: DL-27) produced by CCI Inc. The prepreg 24A had a thickness of 0.0840 mm.

The prepreg "9255G-7" (kind of fiber: M40J, modulus of elasticity in tension: 40 tonf/mm$^2$, thickness: 0.0570 mm) produced by Toray Industries Inc. was used as the prepregs 22, 23. A prepreg "3255G-12" (kind of fiber: T700, was used as the prepreg 21. A prepreg having a article number "9255G-10" (kind of fiber: T700, modulus of elasticity in tension: 24 tonf/mm$^2$, thickness: 0.0840 mm) was used as the prepreg 29. Other constructions of the shaft and the prepreg used therefor were identical to those of the shaft of the example 1.

COMPARISON EXAMPLE 4

The shaft of the comparison example 4 had the same laminated construction as that of the shaft of the example 1 shown in FIG. 2, but was different therefrom in that the loss factor of the second prepreg P2 of the shaft of the comparison example 4 was set to 0.05.

More specifically, as the matrix resin of the prepregs 21 through 23, 25 through 29 composing the first laminate I, a mixture of the DL-26 produced by CCI Inc. and the epoxy resin used at a ratio of 1:6 was used.

The prepreg "9255G-7" (kind of fiber: M40J, modulus of elasticity in tension: 40 tonf/mm$^2$, thickness: 0.0570 mm) produced by Toray Industries Inc. was used as the prepregs 22, 23. A prepreg "3255G-12" (kind of fiber: T700, was used as the prepreg 21. A prepreg having a article number "9255G-10" (kind of fiber: T700, modulus of elasticity in tension: 24 tonf/mm$^2$, thickness: 0.0840 mm) was used as the prepreg 29. Other constructions of the shaft and the prepreg used therefor were identical to those of the shaft of the example 1.

Method of Measuring Grip-Side Flexure

Figure 11:
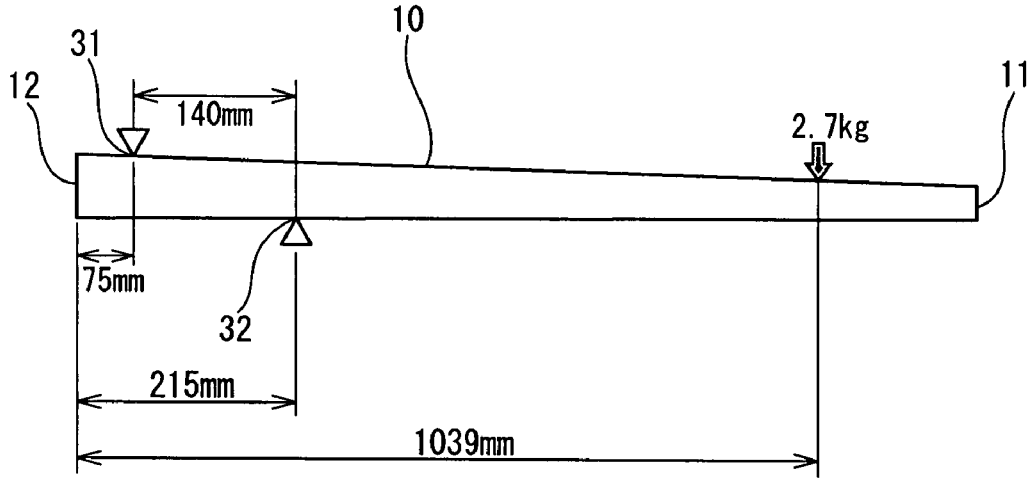
FIG. 11 shows a method of measuring a grip-side flexure.

As shown in FIG. 11, the flexure amount of the shaft 10 at the grip-side butt 12 thereof was measured by applying a load of 2.7 kg to a position spaced at an interval of 1039 mm from the grip-side butt 12, with the shaft 10 supported at the following upper point 31 and lower point 32. The upper point 31 is disposed upward from a position (rear end at the grip-mounting side) spaced at an interval of 140 mm from the spaced at an interval of 75 mm from the grip-side butt 12. The lower point 32 is disposed downward from a position (spaced at an interval of 140 mm from the upper point) spaced at an interval of 215 mm from the grip-side butt 12.

A jig had sectionally the shape of a circular arc having R=15 mm at the portion thereof at which the jig contacted the shaft 10 at the upper point 31 thereof and was concave (R=40 mm) in the direction orthogonal to the shaft 10 and had a length of 15 mm. In the longitudinal direction of the shaft 10, the jig had sectionally the shape of the circular arc having R=15 mm at the portion thereof at which the jig contacted the shaft 10 at the lower point 32 thereof and was concave (R=40 mm) at a central portion thereof in the direction orthogonal to the shaft 10 and had a length of 15 mm. A pressure-applying member had sectionally the shape of a circular arc having R=10 mm at the portion thereof at which the pressure-applying member contacted the shaft 10 at the load-applied position and was straight in the direction orthogonal to the shaft 10. The pressure-applying member had a length of 18 mm.

Method of Measuring Vibration-Damping Factor

Figure 12:
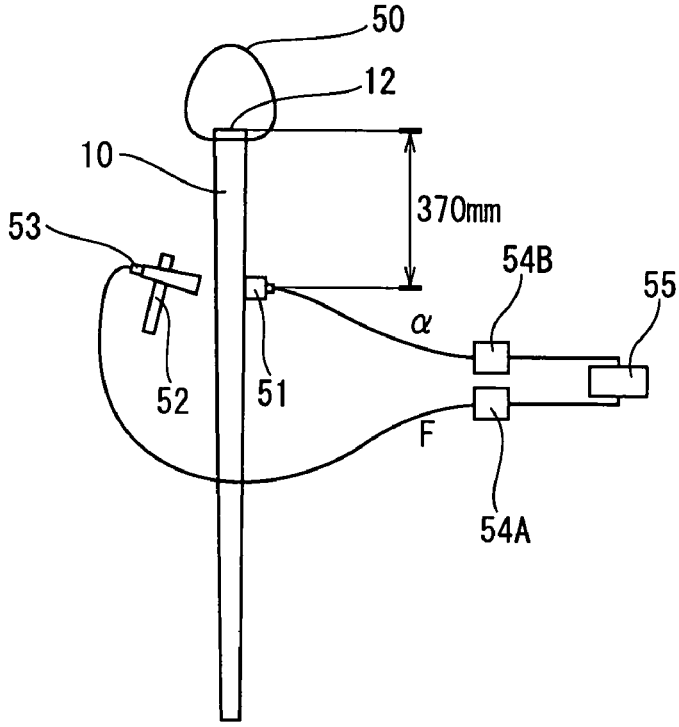
FIG. 12 shows a method of measuring a vibration-damping factor.

As shown in FIG. 12, the grip-side butt 12 of the shaft 10 was hung with a string 50, and an acceleration pick-up meter 51 was mounted on the shaft 10 at a position spaced at an interval of 370 mm from the grip-side butt 12. The side of the shaft 10 opposite to the side on which the acceleration pick-up meter 51 was installed was hit with an impact hammer 52 to vibrate the shaft 10. An input vibration F was measured with a force pink-up meter 53 mounted on the impact hammer 52, and a response vibration $\alpha$ was measured with the acceleration pick-up meter 51. The input vibration F and the response vibration $\alpha$ were inputted to a frequency analyzer 55 (dynamic single analyzer HP3562A manufactured by Hewlett Packard Inc.) through amplifiers 56A and 56B. A transmission function in a frequency region obtained by an analysis was calculated to obtain the frequency of the tennis racket. The vibration-damping ratio ($\zeta$) of the shaft 10, namely, the out-of-plane primary vibration-damping factor thereof was computed by an equation shown below.

$$\zeta=(1/2)\times(\Delta\omega/\omega n)$$

$$To=Tn/\sqrt{2}$$

Measurement of Three-Point Bending Strength

Figure 13:
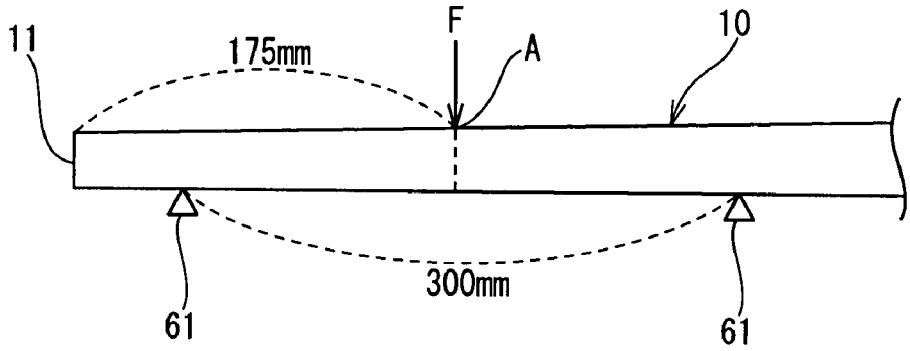
FIG. 13 shows a method of measuring a three-point bending strength.
Figure 14:
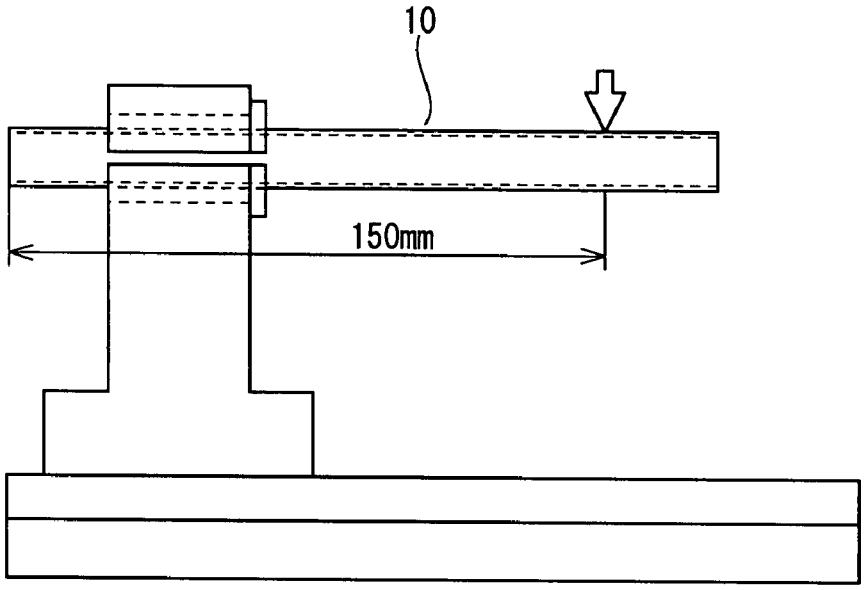
FIG. 14 shows a schematic view showing an impact test method.

The three-point bending strength means a breaking strength provided by the Product Safety Association. As shown in FIG. 13, a load F is applied from above to a shaft 10 supported at three points. A value (peak value) of the load when the shaft 10 was broken was measured. The bending strength was measured at points spaced at intervals of 175 mm (point A), 525 mm (point B) from the tip 11 of the shaft 10, respectively and a point C spaced at an interval of 175 mm (point C) from the grip-side butt 12 of the shaft 10. The span between supporting points 61 was 300 mm when the bending strength was measured at the points A, B, and C (FIG. 13 shows the case in which the bending strength was measured at the point A).

Measurement of Impact Energy

By using a falling impact tester (produced by Yonekura Seisakusho Inc.), a weight of 500 g was dropped from a level spaced at an interval of 1.5 cm from the shaft 10 to a position spaced at an interval of 150 mm from the head-side tip 11 of the shaft 10. A vibration waveform generated when the weight was dropped was read by a vibrometer (produced by Showa Keisoku Kabushiki Kaisha, charge vibrometer model 1607). The vibration waveform was obtained as follows: A decrease amount of speed caused by energy loss with respect to an initial measure was compensated to find a function of the relationship between a load and a displacement and compute an energy value. The following relationship among the displacement, the speed, and the energy establishes:

Equation 1

Displacement $$\zeta = \int_0^t V(t)dt \tag{1}$$

Equation 2

Speed $$V = \sqrt{V_0^2 - \frac{2E(t)}{M}} \tag{2}$$

Equation 3

Energy $$E(t) = \int_0^t I(t)V(t)dt \tag{3}$$

The equations (1), (2), and (3) are solved under conditions of E(0)=0, V(0)=0, and ζ(0)=0 so that solutions are discrete in a quadratic form.

Equation 4

$$\zeta(n+1) = \zeta \times n + \frac{Tn}{2}(V(n) + V(n+1)) \tag{4}$$

Equation 5

$$V(n+1) = \sqrt{V_n^2 - \frac{2}{M}(E(n+1) - E(n))} \tag{5}$$

Equation 6

$$E(n+1) = E(n) + \frac{T}{2}(I(n) \times V(n) + I(n+1) \times V(n+1)) \tag{6}$$

The equation (5) is expanded to $V(n)^2$. Thereafter $V(n)^2$ is substituted into the equation (6) to obtain an equation (7) shown below.

Equation 7

$$E(n+1) = E(n) + \frac{T}{2} \times \frac{(I(n) + I(n+1) \times V(n))}{1 + \frac{T}{2} \times I(n+1) \times \frac{1}{(V(n) \times M)}} \tag{7}$$

The displacement and the energy are computed one by one from the equations (4), (5), and (7).

Figure 15:
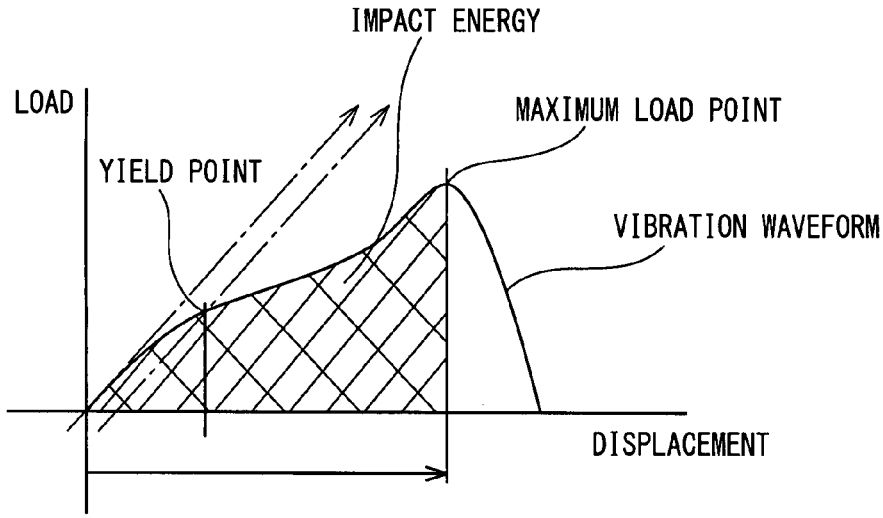
FIG. 15 shows a method of finding an impact energy.
Figure 16A:
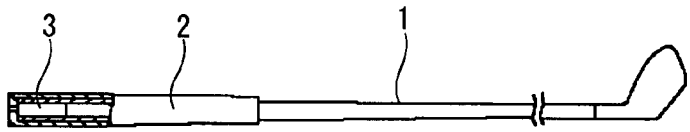
FIG. 16 shows a conventional art.
Figure 16B:
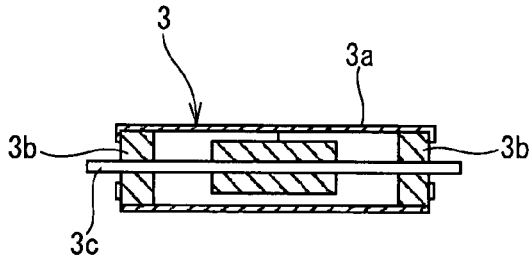
[Prior Art] Fig. 16B
Figure 17A:
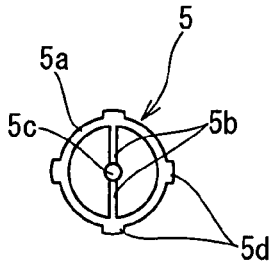
FIG. 17 shows another conventional art.
Figure 17B:
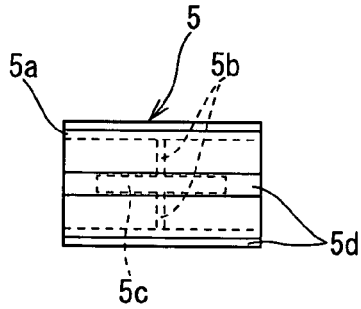
[Prior Art] Fig. 17B
Figure 17C:
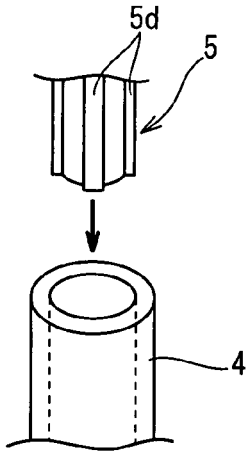
[Prior Art] Fig. 17C
Figure 17D:
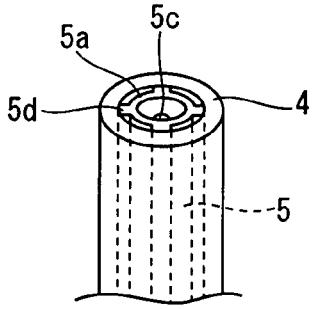
[Prior Art] Fig. 17D

The vibration waveform obtained by the computation is as shown in FIG. 15. The impact energy is computed in the area shown with oblique lines (till a maximum load point) shown in FIG. 15.

Evaluation of Shaft by Hitting Balls

"SRIXON W-505 L10.5", a ferrule and a grip was mounted on each of the shafts of the examples and the comparison examples. 20 golf players having handicaps of 20 to 35 were requested to hit 10 three-piece balls (produced by SRI Sports, "HI-BRID evrio") with each of golf clubs having the shafts mounted thereon respectively to make a sensory evaluation of the vibration-absorbing performance of the shafts on the basis of five points (the larger obtained mark is, the better). Each of the marks shown in table 1 is the average of marks given by 20 golf players.

As apparent from the results shown in table 1, comparing the shaft of the comparison example 1 consisting of the first laminate I (first prepreg P1) with the shafts of the examples 5, 6 in which a part of the first prepreg P1 was replaced with the second prepreg P2, the shafts of the examples 5, 6 had a strength and a grip-side flexure respectively almost equal to those of the shaft of the comparison example 1 and yet had a higher vibration-absorbing performance respectively.

The shafts of the examples 1 through 4 in which the second prepreg P2 was added to the laminated construction of the shaft of the comparison example 1 had a strength and a grip-side flexure respectively almost equal to those of the shaft of the comparison example 1 and yet had higher vibration-absorbing performance respectively.

Comparing the shafts of the examples 9, 10 and those of the comparison examples 4, 5 with each other, it was confirmed that the loss factor of the first laminate I thereof was preferably not less than 0.005 nor more than 0.02. When the loss factor of the first laminate I was less than 0.05, the shafts had a very low vibration-absorbing performance respectively. When the loss factor of the first laminate I was more than 0.02, the shafts had a very low three-point bending strength respectively.

Comparing the shafts of the examples 7, 8 and those of the comparison examples 2, 3 with each other, it was confirmed that the loss factor of the second prepreg P2 thereof was preferably not less than 0.10 nor more than 0.50. When the loss factor of the first laminate I was less than 0.10, the shafts had a very low vibration-absorbing performance respectively. When the loss factor of the first laminate I was more than 0.50, the shafts had a very low three-point bending strength respectively.

Comparing the shafts of the examples 1 through 3 with each other, it was confirmed that the shaft of the example 1 in which the second prepreg P2 was formed at the head-side tip portion had higher vibration-absorbing performance and impact energy than the shafts of the examples 2, 3 having the second prepreg P2 formed at the central portion and the grip side thereof respectively.

The shaft of the example 4 having the second prepreg P2 formed over the full length thereof had a larger weight than the shafts of the other examples, but had a higher impact energy.

Comparing the shafts of the example 3 and the shafts of the examples 10, 11 with each other, it was confirmed that the shaft of the example 3 having the second prepreg P2 disposed in the central region in the thickness direction of the layer of the fiber reinforced prepregs had vibration-absorbing performance superior to that of the shafts of the examples 10, 11 having the second prepreg P2 disposed in the peripheral side and the inner peripheral side in the thickness direction of the layer of the fiber reinforced prepregs respectively.

What is claimed is:

1. A golf club shaft, said golf club shaft being tubular and having a hollow portion, comprising a laminate of fiber reinforced prepregs composed of a matrix resin and reinforcing fibers impregnated with said matrix resin, wherein said laminate includes a first part composed of a plurality of first prepregs and a second part, a loss factor (tan δ) of said first part is set to not less than 0.005 nor more than 0.02, when said loss factor is measured at a frequency of 10 Hz under a condition of 10° C.; and a loss factor (tan δ) of said second part is set to not less than 0.10 nor more than 0.50, when said loss factor is measured at a frequency of 10 Hz under said condition of 10° C.

2. The golf club shaft according to claim 1, wherein a weight of said second part is set to not less than 1% nor more than 15% of a weight of said first part composed of a plurality of said first prepregs layered on one another.

3. The golf club shaft according to claim 1, wherein an entire thickness of said fiber reinforced resin layer is 100%, at least one part of said second part is disposed in a thickness range within 20% of said entire thickness of said fiber reinforced resin layer at both sides in a thickness direction with respect to a central position of said entire thickness.

4. The golf club shaft according to claim 1, wherein a matrix resin composition of said second part contains epoxy resin and an activator having dipoles added to said epoxy resin, a modulus of elasticity in tension of reinforcing fibers of said first prepreg and said second part is set to not less than 15 tonf/mm$^2$ nor more than 60 tonf/mm$^2$.

5. The golf club shaft according to claim 4, wherein said second part comprises a composition containing epoxy resin and one or more activators selected from among compounds having a benzotriazole group and compounds having a diphenyl acrylate group added to said epoxy resin.

6. The golf club shaft according to claim 1, wherein said second part is disposed in a region from a head-side tip of said golf club shaft to a position spaced at an interval of 30% of a whole length of said golf club shaft from said head-side tip of said golf club shaft.

7. The golf club shaft according to claim 1, wherein an orientation angle of reinforcing fibers of said second part to an axis of said golf club shaft is set to not less than 30° nor more than 90°.

* * * * *